US011268504B2

(12) United States Patent
Lee et al.

(10) Patent No.: US 11,268,504 B2
(45) Date of Patent: Mar. 8, 2022

(54) LINEAR COMPRESSOR COMPRISING A STATOR DEFINING A CYLINDER SPACE FOR A CYLINDER SUPPORTED BY A SUPPORT MEMBER WITH A CYLINDRICAL PORTION, A FIRST BENT PORTION, AND A SECOND BENT PORTION CONFIGURED TO SUPPORT AN AREA OF THE CYLINDER IN AN AXIAL DIRECTION

(71) Applicant: LG Electronics Inc., Seoul (KR)

(72) Inventors: Jongkoo Lee, Seoul (KR); Sungchul Gong, Seoul (KR); Susok Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 225 days.

(21) Appl. No.: 16/145,344

(22) Filed: Sep. 28, 2018

(65) Prior Publication Data

US 2019/0093645 A1 Mar. 28, 2019

(30) Foreign Application Priority Data

Sep. 28, 2017 (KR) ..... 10-2017-0126408
Nov. 6, 2017 (KR) ..... 10-2017-0146890
Nov. 15, 2017 (KR) ..... 10-2017-0152408

(51) Int. Cl.
*F04B 35/04* (2006.01)
*F04B 39/02* (2006.01)
(Continued)

(52) U.S. Cl.
CPC ..... *F04B 35/04* (2013.01); *F04B 35/045* (2013.01); *F04B 39/0276* (2013.01);
(Continued)

(58) Field of Classification Search
CPC ..... F04B 35/04; F04B 39/121; F04B 39/14; F04B 35/045; F04B 39/0044; F04B 39/02;
(Continued)

(56) References Cited

U.S. PATENT DOCUMENTS

2003/0147759 A1* 8/2003 Chang ..... F04B 35/045 417/417
2005/0112000 A1* 5/2005 Jung ..... F04B 35/045 417/417
(Continued)

FOREIGN PATENT DOCUMENTS

DE 102006009268 8/2007
EP 2719896 4/2014
(Continued)

OTHER PUBLICATIONS

Partial European Search Report in European Application No. 18195970.1, dated Aug. 1, 2019, 7 pages.
(Continued)

*Primary Examiner* — Kenneth J Hansen
*Assistant Examiner* — Benjamin Doyle
(74) *Attorney, Agent, or Firm* — Fish & Richardson P.C.

(57) ABSTRACT

A linear compressor includes a mover which linearly reciprocates, a stator generating a driving force to allow the mover to linearly reciprocate and having a cylinder space formed on an inner circumferential surface thereof, a cylinder inserted into the cylinder space of the stator and having a compression space compressing a refrigerant, a piston reciprocating in an axial direction inside the cylinder, a frame provided on one side of the stator in an axial direction and supporting the stator in the axial direction, and a cylinder support member separated from the frame, provided between an inner circumferential surface of the stator
(Continued)

and an outer circumferential surface of the cylinder, having one end fixed to the stator and the other end fixed to the cylinder, and supporting the cylinder with respect to the stator in the axial direction.

15 Claims, 25 Drawing Sheets

(51) Int. Cl.
*F04B 39/12* (2006.01)
*F04B 39/14* (2006.01)

(52) U.S. Cl.
CPC ..... *F04B 39/121* (2013.01); *F04B 39/122* (2013.01); *F04B 39/127* (2013.01); *F04B 39/14* (2013.01)

(58) Field of Classification Search
CPC .... F04B 39/0276; F04B 39/10; F04B 39/122; F04B 39/127; F04B 39/0061; F04B 39/0027
USPC ..... 417/417, 415, 437
See application file for complete search history.

(56) References Cited

U.S. PATENT DOCUMENTS

2015/0226191 A1* 8/2015 Ki ..... F04B 53/20 417/53
2015/0285235 A1* 10/2015 Ahn ..... F04B 35/045 417/416
2015/0369224 A1* 12/2015 Kim ..... F04B 39/0292 417/443
2015/0369225 A1* 12/2015 Ha ..... F04B 39/122 417/443
2015/0369237 A1* 12/2015 Ahn ..... F04B 35/045 417/564
2015/0369238 A1* 12/2015 Park ..... F04B 39/0005 417/437
2016/0003253 A1* 1/2016 Lee ..... F04C 29/0085 417/420
2016/0017876 A1* 1/2016 Kim ..... F04B 39/125 417/443
2016/0017877 A1* 1/2016 Ki ..... F04B 39/127 417/437
2016/0017878 A1* 1/2016 Kim ..... F04B 39/126 417/437
2016/0017883 A1* 1/2016 Noh ..... F04B 35/045 417/437
2017/0298913 A1* 10/2017 Kim ..... F04B 9/06
2017/0321673 A1* 11/2017 Lee ..... C23C 28/343

FOREIGN PATENT DOCUMENTS

| | | |
|---|---|---|
| JP | 2000120535 | 4/2000 |
| JP | 2001221159 | 8/2001 |
| JP | 4246411 | 1/2003 |
| JP | 2005195022 | 7/2005 |
| KR | 10-0214637 | 5/1999 |
| KR | 10-2006-0086681 | 8/2006 |
| KR | 1020070094382 | 9/2007 |
| KR | 1020150040027 | 4/2015 |
| KR | 10-2016-0000300 | 1/2016 |
| KR | 1020160024217 | 3/2016 |
| KR | 1020170074527 | 6/2017 |
| KR | 10-2017-0086841 | 7/2017 |

OTHER PUBLICATIONS

KR Notice of Allowance in Korean Appln. No. 10-2019-0060232, dated Dec. 21, 2020, 10 pages (with English translation).

* cited by examiner

LINEAR COMPRESSOR COMPRISING A STATOR DEFINING A CYLINDER SPACE FOR A CYLINDER SUPPORTED BY A SUPPORT MEMBER WITH A CYLINDRICAL PORTION, A FIRST BENT PORTION, AND A SECOND BENT PORTION CONFIGURED TO SUPPORT AN AREA OF THE CYLINDER IN AN AXIAL DIRECTION

CROSS-REFERENCE TO RELATED APPLICATIONS

Pursuant to 35 U.S.C. § 119(a), this application claims the benefit of earlier filing date and right of priority to Korean Application No. 10-2017-0126408, filed on Sep. 28, 2017, Korean Application No. 10-2017-0146890, filed on Nov. 6, 2017, and Korean Application No. 10-2017-0152408, filed on Nov. 15, 2017, the contents of which are incorporated by reference herein in their entirety.

FIELD

The present disclosure relates to a linear compressor.

BACKGROUND

In a reciprocating compressor, a compression space is formed between a piston and a cylinder and the piston reciprocates linearly to compress a fluid. Reciprocating compressors are known to include a crank type reciprocating compressor that compresses a refrigerant by converting a rotational force of a rotary motor into a linear motion, and a vibration type reciprocating compressor that compresses a refrigerant using a linear motor that makes a linear reciprocating motion. The vibration type reciprocating compressor is termed a linear compressor. Such a linear compressor does not make mechanical loss in converting a rotational motion into a linear reciprocating motion, improving efficiency and having a simple structure.

The linear compressor may be classified as an oil lubrication type linear compressor and a gas lubrication type linear compressor according to the lubrication method. The oil lubrication type linear compressor is configured to store a certain amount of oil in a casing and lubricate between a cylinder and a piston using the oil as disclosed in Patent document 1 (Korean Patent Laid-Open Publication No. 10-2015-0040027). Meanwhile, as disclosed in Patent document 2 (Korean Patent Laid-Open Publication No. 10-2016-0024217), the gas lubrication type linear compressor is configured such that, without storing oil in a casing, a portion of a refrigerant discharged from a compression space is guided between a cylinder and a piston to lubricate between the cylinder and the piston by a gas force of the refrigerant.

In both the oil lubrication type linear compressor and the gas lubrication type linear compressor as described above, an outer stator and an inner stator, which form the stators of the linear motor, are supported by a frame. Thus, a gap allowing a mover to reciprocate is maintained between the outer stator and the inner stator. Also, the inner stator is inserted into an outer circumferential surface of the frame and a cylinder is inserted into an inner circumferential surface of the frame to support radial and axial directions of the inner stator and the cylinder.

Further, in the case of the gas lubrication type, the frame and the cylinder are assembled to secure a certain gap so that a refrigerant passage forming a gas bearing is formed between the inner circumferential surface of the frame and the outer circumferential surface of the cylinder.

However, since the related art linear compressor as described above is formed to support both the stator and the cylinder by the frame, a shape of the frame may be complicated. Thus, dimensions of the frame must be precisely controlled, which significantly increases processing cost for the frame.

In addition, in the related art linear compressor, the frame is formed to support both the stator and the cylinder, although it is formed of a material which is expensive, relative to other members. Thus, as the size of the frame is increased, material cost for the frame is increased. That is, as the frame supports the stator, the frame is formed of a material having relatively low magnetic permeability such as aluminum in consideration of leakage of magnetic flux, which, however, increases material cost.

In addition, in the related art linear compressor, as a front end of the cylinder is axially supported at a front end of the frame, a length of the cylinder is increased, so that material cost for the cylinder increases and a length of the compressor is increased.

In addition, in the related art linear compressor, since a discharge valve for opening and closing a discharge side of the compression space is provided outside the linear motor, the length of the linear compressor in the axial direction increases and the length of the piston is increased, which is disadvantageous for a high-speed operation and increases friction loss.

In addition, in the related art linear compressor, since the discharge valve is provided outside the linear motor, a discharge cover, which accommodates the discharge valve is coupled to one axial side of the frame so as to be assembled to increase an assembling process to increase manufacturing cost.

In addition, since the related art linear compressor is provided with a support member supporting a compressor main body with respect to a casing, the number of components is increased to result in a complicated structure of the compressor, and also, since a space for installing the support member is required, the size of the compressor is increased accordingly.

In addition, in the related art linear compressor, when the compressor main body is supported by the support member having an elastic force, sagging of the compressor main body may occur to cause alignment of components constituting the compressor main body may be distorted. As a result, collision may occur between components, leading to a decrease in reliability or an increase in friction loss.

In addition, in the related art linear compressor, since the compressor main body is installed inside the airtight casing, heat generated by the compressor main body may not be quickly dissipated to degrade efficiency of the compressor.

SUMMARY

Therefore, an aspect of the detailed description is to provide a linear compressor having a simple frame structure, thus reducing processing cost for a frame.

Another aspect of the present disclosure is to provide a linear compressor in which a size of a frame, which is formed of a relatively expensive material, is reduced to reduce material cost.

Another aspect of the present disclosure is to provide a linear compressor in which a member supporting a cylinder in an axial direction is separately provided in addition to a frame to reduce a length of the cylinder, whereby material cost for the cylinder may be reduced and a size of the compressor may be reduced.

Another aspect of the present disclosure is to provide a linear compressor in which a discharge valve is provided inside the linear motor to reduce a length of a piston, as well as reducing a length of the compressor in an axial direction, whereby the linear compressor is advantage for a high-speed operation and a friction loss may be reduced.

In the case of a gas lubrication type linear compressor in which lubrication is provided between a cylinder and a piston using a refrigerant, if a lubricant passage guiding a lubricant between the cylinder and the piston is not sealed in the process of simplifying a structure of a frame, the lubricant may be leaked to significantly degrade performance of a gas bearing. It is therefore an aspect of the present disclosure to provide a linear compressor in which a refrigerant is smoothly provided between a cylinder and a piston, while a frame structure is simplified.

Another aspect of the present disclosure is to provide a linear compressor in which a member supporting a compressor main body with respect to a casing is simplified to reduce the number of parts, thus reducing manufacturing cost and a size of the component.

Another aspect of the present disclosure is to provide a linear compressor in which a compressor main body is restrained from sagging or tilting so that the compressor main body may be aligned with respect to a casing, while maintaining a predetermined space therebetween.

Another aspect of the present disclosure is to provide a linear compressor in which a compressor main body is exposed so that heat generated by the compressor main body is rapidly dissipated.

To achieve these and other advantages and in accordance with the purpose of this specification, as embodied and broadly described herein, a linear compressor includes: a frame supporting an outer stator and an inner stator; a cylinder inserted into the inner stator and having a compression space; a piston slidably inserted into the cylinder to reciprocate; and a cylinder support member provided between the inner stator and the cylinder and having one end supported by the inner stator in an axial direction and the other end supported by the cylinder in the axial direction.

The cylinder support member may be formed to be shorter in an axial length than the cylinder, and a coating layer may be formed on an inner circumferential surface of the inner stator to perform sealing.

The cylinder support member may be formed to be longer in the axial length than the cylinder.

To achieve these and other advantages and in accordance with the purpose of this specification, as embodied and broadly described herein, a linear compressor includes: a mover which linearly reciprocates; a stator generating a driving force to allow the mover to linearly reciprocate and having a cylinder space formed at an inner space thereof; a cylinder inserted into the cylinder space of the stator and having a compression space compressing a refrigerant; a piston reciprocating in an axial direction inside the cylinder; a frame provided on one side of the stator in an axial direction and supporting the stator in the axial direction; and a cylinder support member separated from the frame, provided between an inner circumferential surface of the stator and an outer circumferential surface of the cylinder, having one end fixed to the stator and the other end fixed to the cylinder, and supporting the cylinder with respect to the stator in the axial direction.

The cylinder support member may include a cylindrical portion and first and second bent portions provided at both ends of the cylindrical portion, the first bent portion may be bent outwards so as to be supported by the stator in the axial direction, and the second bent portion may be bent inwards to support a cross-section of the cylinder in the axial direction.

A fixing recess may be formed on an inner circumferential surface of stator forming the cylinder space so that the first bent portion of the cylinder support member is inserted therein and supported in the axial direction.

A sealing portion may be formed on an inner circumferential surface of the stator forming the cylinder space such that a refrigerant is accommodated between the inner circumferential surface of the stator and an outer circumferential surface of the cylinder, and the sealing portion may be smaller than a thickness of the cylinder support member.

A length of the cylinder support member in the axial direction may be shorter than a length of the cylinder in the axial direction, an annular seating recess may be formed on an inner circumferential surface of the stator forming the cylinder space so that the cylindrical portion of the cylinder support member is inserted therein, and a depth of the seating recess in a radial direction may be greater than or equal to a thickness of the cylindrical portion.

A recess may be formed on one side surface of the stator in the axial direction or on one side surface of the frame facing the one side surface of the stator in the axial direction so that the first bent portion of the cylinder support member is inserted and supported in the axial direction.

The length of the cylinder support member in the axial direction may be greater than the length of the cylinder in the axial direction.

A discharge valve opening and closing the compression space may be further provided on a front end surface of the cylinder, and the discharge valve may be provided inside the cylinder space.

A discharge valve opening and closing the compression space may be further provided on a front end surface of the cylinder, and the discharge valve may be provided outside the cylinder space.

A thickness of the cylinder support member in a radial direction may be smaller than a thickness of the frame in the axial direction.

The cylinder support member may be formed of a material having rigidity higher than that of the frame.

At least one discharge space accommodating a refrigerant discharged from the compression space may be formed in the cylinder space.

A discharge cover covering the cylinder space may be coupled to the frame.

A cover part may be integrally formed in the frame to cover the cylinder space.

The cylinder support member may have an annular disk shape, and an outer circumferential portion of the cylinder support member may be inserted into and fixed to an inner circumferential surface of the cylinder space, and an inner circumferential portion of the cylinder support member may be tightly attached to one end of the cylinder to support the cylinder in the axial direction.

The cylinder may have a bearing hole guiding a refrigerant discharged from the compression space to between the cylinder and the piston.

To achieve these and other advantages and in accordance with the purpose of this specification, as embodied and broadly described herein, a linear compressor includes: a compressor main body including a cylinder having a compression space to compress a refrigerant, a piston reciprocating in an axial direction inside the cylinder, a mover coupled to the piston and transferring a driving force to the piston, a stator having a cylinder space allowing the cylinder to be inserted and coupled thereto and generating a driving force together with the mover, a frame supporting the stator in the axial direction, and a discharge valve selectively opening and closing the compression space; at least one first guide installed in the compressor main body; and at least one second guide installed to be spaced apart from the compressor main body to correspond to the first guide, allowing the first guide to be slidably inserted therein to support a load in a gravity direction of the compressor main body, wherein the compressor main body includes a cylinder support member inserted into the cylinder space and supporting the cylinder in the axial direction, and the cylinder support member is separated from the frame and has one end fixed to the stator and the other end supporting the cylinder in the axial direction on the opposite side of the compression space.

The linear compressor may further include: an elastic member providing an elastic force between the first guide and the second guide.

The compressor main body may be supported by a plurality of brackets exposed to the outside in the axial direction and in a radial direction.

In the linear compressor according to the present invention, the outer stator and the inner stator constituting the driving unit are supported by the frame, while the cylinder is inserted into the inner stator and supported by the cylinder support member, so that the structure of the frame may be simplified, and thus, manufacturing cost of the frame may be reduced.

In the linear compressor according to the present invention, since the frame is in contact with the outer stator and the inner stator, the frame is formed of a high-priced non-magnetic material. However, since only one surface of the both stators is supported by the frame, the size of the frame may be minimized. Accordingly, although the frame is formed of a high-priced non-magnetic material, a material cost due to the frame may be reduced.

In the linear compressor according to the present invention, since the cylinder is supported by the separate cylinder support member in a state in which the cylinder is inserted in to the inner stator, the length of the cylinder may be reduced. As a result, a material cost for the cylinder may be reduced and the compressor weight may be reduced.

Further, according to the linear compressor of the present invention, as the discharge valve is inserted into the inner stator forming the cylinder space, the axial length of the compressor may be shortened and the axial length of the piston is also shortened as much, which advantageously reduces a size and supports a high speed.

In the linear compressor according to the present invention, since the discharge valve is inserted into the inner stator forming the cylinder space, the discharge cover may be formed integrally with the frame, thereby reducing the number of assembly processes to reduce a manufacturing cost of the compressor.

In addition, in the linear compressor according to the present invention, since the coating layer is formed on the inner circumferential surface of the inner stator, while the cylinder is inserted to the inside of the inner stator forming a cylinder space, leakage of a refrigerant to between the stator sheets forming the inner stator may be prevented. Accordingly, the refrigerant discharged to the cylinder space may be smoothly guided to between the cylinder and the piston to stably lubricate the piston.

In the linear compressor according to the present invention, the first guide is provided in the compressor main body and the second guide is provided in the casing and are slidably inserted to each other to prevent sagging or tilting of the compressor main body to maintain a predetermined space between the casing and the compressor main body. Accordingly, the compressor main body is uniformly aligned inside the casing, limiting generation of friction or an impact between the components forming the compressor main body even when the compressor is driven. Also, a separate support structure for supporting the compressor main body in the casing is not required, simplifying the structure of the compressor, reducing the size of the compressor, and reducing a manufacturing cost.

In addition, since the linear compressor according to the present invention includes the elastic member between the first guide and the second guide, it is possible to absorb an impact that occurs when the compressor reciprocates, thereby reducing vibration noise of the compressor.

Further, in the linear compressor according to the present invention, since the casing is removed and the compressor main body is supported by the exposed bracket, heat generated in the compressor main body may be quickly dissipated.

Further scope of applicability of the present application will become more apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION

Description will now be given in detail of the exemplary embodiments, with reference to the accompanying drawings. For the sake of brief description with reference to the drawings, the same or equivalent components will be provided with the same reference numbers, and description thereof will not be repeated.

Hereinafter, a linear compressor according to the present disclosure will be described in detail with reference to the accompanying drawings.

The linear compressor according to the present disclosure performs an operation of sucking and compressing a fluid and discharging a compressed fluid. The linear compressor according to the present disclosure may be a component of a refrigerating cycle. Hereinafter, a refrigerant circulating in a refrigerating cycle will be described as an example of a fluid.

Figure 1:
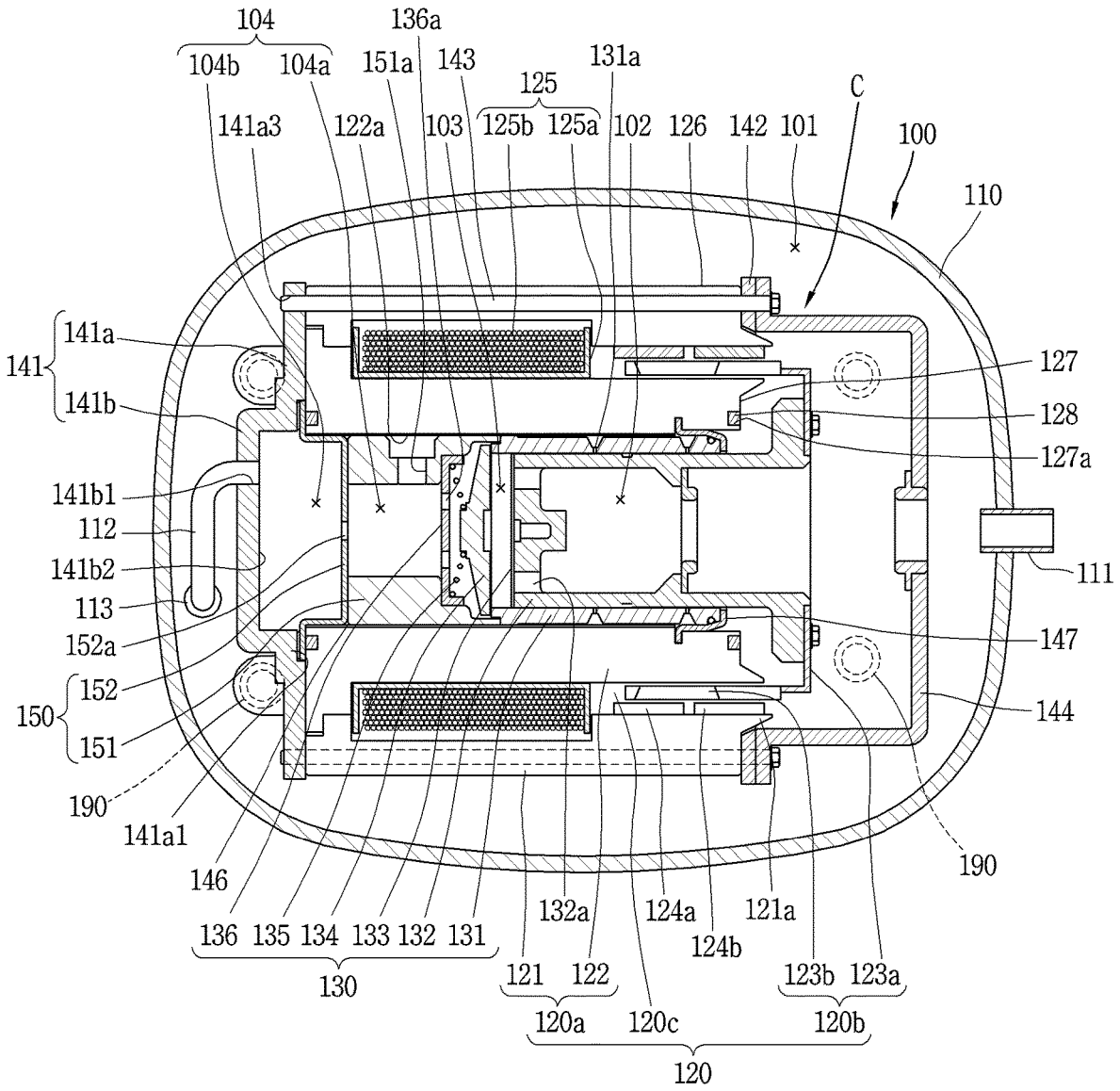
FIG. 1 is an upper cross-sectional view illustrating the inside of a linear compressor according to the present disclosure.

FIG. 1 is a cross-sectional view illustrating an embodiment of a linear compressor according to the present disclosure. As illustrated in FIG. 1, a linear compressor 100 according to the present embodiment includes a casing 110, a driving unit 120, and a compression unit 130. The driving unit 120 and the compression unit 130 may be collectively referred to as a compressor main body C.

The casing 110 forms an airtight internal space. The airtight internal space is a suction space 101 filled with a refrigerant to be sucked and a suction pipe 111 may be connected to the casing 110 so that the refrigerant is sucked into the suction space 101. In addition, a discharge pipe 113 may be connected to the casing 110 so that a refrigerant is discharged from a discharge space 104, which will be described later, to the outside.

The linear motor constituting the driving unit 130 may be elastically supported by a support spring 190 and installed in the suction space 101 of the casing 110. The support spring 190 may be a leaf spring or a coil spring. In this embodiment, a coil spring is applied. The support spring 190 formed as a coil spring supports four portions of a lower end of the compressor main body at four places. However, in another embodiment to be described later, a leaf spring is applied.

The casing 110 may extend in a transverse direction or in a longitudinal direction depending on the arrangement of the driving unit 120 and the compression unit 130. In addition, the casing 110 may be formed by covering a lower housing with an upper housing or by covering both ends of a cylindrical shell with caps, respectively. FIG. 1 illustrates an example in which a cylindrical shell is formed to extend in a transverse direction and both ends thereof are covered with caps.

The driving unit 120 may include a stator 120*a* and a mover 120*b* reciprocating with respect to the stator 120*a*.

The stator 120*a* may include an outer stator 121 and an inner stator 122 disposed inside the outer stator 121 and spaced apart from the outer stator 121 by a predetermined gap 120*c*. A frame 141 and a stator cover 142, which will be described later, are tightly attached to a front surface and a rear surface of the outer stator 121 and the inner stator 122 assembly bolts 143 to maintain the gap 120*c*.

The mover 120*b* may include a core holder 123*a* and a magnetic core 123*b* supported by the core holder 123*a*.

The core holder 123*c* has a cylindrical shape, and one end of the core holder 123*a* is coupled to a piston 132 to be described later and the other end of the core holder 123*a* is inserted into the gap 120*c* between the outer stator 121 and the inner stator 122 so as to be movable in a reciprocating manner.

The magnetic core 123*b* may be formed by stacking a plurality of magnetic sheets or may be manufactured as a block and press-fit to the core holder 123*a*. However, the magnetic core 123*b* may be adhered and fixed to an outer circumferential surface of the core holder 123*a* or may be fixed using a separate fixing ring (not shown). The magnetic core 123*b* may reciprocate linearly together with the core holder 123*a* by mutual electromagnetic force formed between the outer stator 121 and the inner stator 122.

Meanwhile, the compression unit 130 sucks a refrigerant inside the suction space 101 into the compression space 103, compresses the refrigerant, and discharges the compressed refrigerant into the discharge space 104. The compression unit 130 may be located at the center of the casing 110 inside the inner stator 122 and includes a cylinder 131 and a piston 132. The cylinder 131 is inserted and supported in a cylinder space 122*a* of the inner stator 12, and a compression space 103 may be formed therein.

The cylinder 131 may have a cylindrical shape having both ends opened to receive the refrigerant and the piston 132 therein. The cylinder 131 may be inserted in and fixed to the cylinder space 122*a* of the inner stator 122 to be described later. The cylinder 131 is formed to be shorter than an axial length of the inner stator 122 and may be disposed on a rear side with respect to the middle of the cylinder space 122*a*. This will be explained later.

One end (hereinafter, referred to as a front end) of the cylinder 131 may be closed by a discharge valve 134 to be described later and a discharge space 104 for accommodating the refrigerant discharged from the compression space 103 may be formed on the opposite side of the compression space 103 with respect to the discharge valve 134. The discharge space 104 may be a single space, or a plurality of discharge spaces may be formed to communicate with each other in order to effectively attenuate discharge noise.

The discharge space 104 may include a first discharge space 104*a* formed inside the inner stator 122, i.e., in the cylinder space 122*a* and a second discharge space 104*b* formed outside the inner stator 122. In case where the second discharge space 104*b* is formed outside the stator 122, the second discharge space 104*b* is exposed to the suction space 101 of the casing 110, and thus, a temperature of the discharged refrigerant may be lowered to increase compressor efficiency.

A part of a gas bearing guiding the refrigerant between the cylinder 131 and the piston 132 may be formed in the cylinder 131. That is, a plurality of bearing holes 131*a* penetrating from an outer circumferential surface to an inner circumferential surface of the cylinder 131 to form a part of the gas bearing may be formed. A part of the compressed refrigerant is supplied to a space between the cylinder 131 and the piston 132 through the bearing hole 131*a* to provide lubrication between the cylinder 131 and the piston 132.

The bearing hole 131*a* may be formed as a fine hole so that an inlet thereof is wide and an outlet thereof serves as a nozzle. A filter (not shown) blocking an introduction of a foreign material may be provided at the inlet part of the bearing hole 131*a*. The filter may be a mesh filter formed of a metal or may be formed by winding a member such as a fine wire. Accordingly, the inlet and outlet of the bearing hole 131*a* may be individually formed so as to communicate with each other independently, and the inlet may be formed as an annular recess and the outlet may be formed as a plurality of bearing holes at regular intervals along the annular recess.

The bearing hole 131*a* may be formed only on a side (hereinafter, referred to as a "front side") adjacent to the compression space 103 with respect to an axial center of the cylinder 131, or may also be formed on a rear side, i.e., the opposite site, in consideration of sagging of the piston 132.

The piston 132 may have a suction flow path 102 therein and have a cylindrical shape in which a front end thereof is partially opened while a rear end thereof is completely opened. As described above, the piston 132 may reciprocate with the core holder 123*a* as the rear end, i.e., the open end, thereof is connected to the core holder 123*a*.

A plurality of suction ports 132*a* allowing the suction flow path 102 and the compression space 103 to communicate with each other are formed at the front end of the piston 132. A suction valve 133 for selectively opening and closing the plurality of suction ports 132*a* may be provided on a front side of the piston 132. Accordingly, the refrigerant sucked into the internal space 101 of the casing 110 may open the suction valve 133 and may be sucked to the compression space 103 between the cylinder 131 and the piston 132 through the suction flow path 102 and the suction port 132*a*.

The suction valve 133 may have a disc shape to collectively open and close the plurality of suction ports 132*a* or may have a petal shape having a plurality of opening and closing portions to individually open and close each suction port 132*a*.

A fixed portion of the suction valve 134 is fixed according to positions of the suction port 132*a*. For example, in case where the suction port 132*a* is formed at an edge, a central portion of the suction valve 134 may be bolted or riveted to the center of the front surface of the piston 132.

The discharge valve 134 may be elastically supported by a valve spring 135 to open and close the compression space 103 on a front side of the cylinder 131, and the valve spring 135 may be supported by a valve stopper 150. The valve stopper 150 may include a spring support member 136 stably supporting the valve spring 135. The spring support member 136 may have a disk shape to form a plurality of first discharge holes 136*a*.

Reference numeral 112 denotes a loop pipe, reference numeral 144 denotes a back cover, reference numeral 151 denotes a body portion of the valve stopper, reference numeral 151*a* denotes a bearing communication hole forming a gas bearing, reference numeral 152 denotes a baffle portion of the valve stopper, and reference numeral 152*a* denotes a second discharge hole.

The linear compressor according to this embodiment described above operates as follows.

That is, when a current is applied to the driving unit 120, a magnetic flux is formed in the stator 120*a*, and the mover 120*b* having the magnetic core 123*b* may linearly reciprocate in the gap 120*c* between the outer stator 121 and the inner stator 122 by electromagnetic force generated by the magnetic flux.

Then, as the piston 132 connected to the mover 120*b* linearly reciprocates in the cylinder 131, the volume of the compression space 103 is increased or decreased. Here, when the piston 132 moves backwards and the volume of the compression space 103 increases, the suction valve 133 is opened and the refrigerant in the suction flow path 102 is sucked into the compression space 103 through the suction port 132*a*, whereas when the piston 132 moves forwards and the volume of the compression space 103 decreases, the piston 132 compresses the refrigerant in the compression space 103. The compressed refrigerant opens the discharge valve 134 so as to be discharged to the first discharge space 104*a*.

A portion of the refrigerant discharged to the first discharge space 104*a* is supplied between the inner circumferential surface of the cylinder 131 and the outer circumferential surface of the piston 132 through the bearing communication hole 151*a* forming a gas bearing and through the bearing hole 131*a* of the cylinder 131 to support the piston 132 with respect to the cylinder 131. Meanwhile, the other remaining refrigerant discharged to the first discharge space 104*a* moves to the second discharge space 104*b* through the second discharge hole 152*a* and is subsequently discharged to the outside of the compressor through the loop pipe 112 and the discharge pipe 113 and moves to the condenser of the refrigerating cycle. These sequential processes are repeatedly performed. Here, when the refrigerant sequentially passes through the first discharge space 104*a* and the second discharge space 104*b*, noise of the refrigerant may be further attenuated.

Meanwhile, in the driving unit according to the present embodiment, when a current is applied to a winding coil (to be described later), a magnetic flux is formed in the stator, and a force allowing the mover to move in a horizontal direction of the drawing may be generated due to an interaction between the magnetic flux formed by the applied current and a magnetic force formed in the magnetic core of the mover (to be described hereinafter). Accordingly, the driving unit of the linear compressor according to the present disclosure may serve as a magnetic resonance spring to replace a mechanical resonance spring. A process in which the driving unit serves as magnetic resonance spring is as follows.

Figure 2:
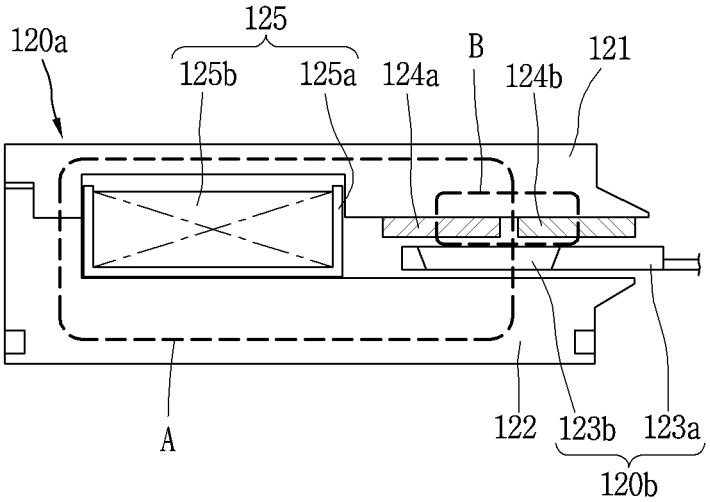
FIG. 2 is a schematic view illustrating a magnetic resonance spring of a linear motor in the linear compressor according to FIG. 1.

Referring to FIGS. 1 and 2, the driving unit according to the present embodiment may include the stator 120*a* and the mover 120*b* reciprocating with respect to the stator 120*a*. The stator 120*a* may include an outer stator 121 and an inner stator 122 disposed on an inner side of the outer stator 121 with a predetermined gap 120*c* therebetween.

The outer stator 121 includes a coil winding body 125 and a stator core 126 laminated to surround the coil winding body 125 and the coil winding body 125 may include a bobbin 125*a* and a bobbin 125*a* and a winding coil 125*b* wound in a circumferential direction of the bobbin 125*a*. A cross-section of the winding coil 125*b* may have a circular shape or a polygonal shape. For example, the cross-section of the winding coil 125*b* may have a hexagonal shape.

In addition, the stator core 126 may be formed by radially laminating a plurality of lamination sheets or by laminating a plurality of lamination blocks in a circumferential direction. In the present embodiment, an example in which a plurality of lamination blocks is laminated in the circumferential direction is described. Accordingly, the assembly bolt 143 pass between the lamination blocks 126*a* and both ends thereof may be coupled to the frame 141 and the stator cover 142 as illustrated in FIG. 1.

The inner stator 122 may have a cylindrical shape by stacking a plurality of lamination sheets 127 radially. The plurality of lamination sheets 127 may maintain the cylindrical shape by press-fitting fixing rings 128 to the fixing recesses 127*a* provided on both the front and rear sides.

Accordingly, a cylinder-shaped cylinder space 122*a* is formed at the center of the inner stator 122, and a cylinder 131, which will be described later, is inserted and fixed in the cylinder space 122*a*. Also, portions of the first discharge space 104*a* and the second discharge space 104*b* as described above may be formed in the remaining space of the cylinder space 122*a* where the cylinder 131 is inserted.

The outer stator 121 and the inner stator 122 may be spaced apart from each other on front and rear sides with the coil winding body 125 interposed therebetween to have a plurality of gaps (not shown), and or may be spaced from each other on one side with the winding coil body 120 interposed therebetween to form the gap 120*c* and connected on the other side to form a single gap. In this case, magnets 124*a* and 124*b* may be coupled to the mover 120*b* or may be coupled to the stator 120*a*. In this embodiment, a linear motor in which the outer stator 121 and the inner stator have a single gap and the magnet is coupled to the stator will be described as an example.

As illustrated in FIG. 1, the magnets 124*a* and 124*b* as permanent magnets may be attached and coupled to a pole portion 121*a* of the outer stator 121 forming the gap 120*c*. The pole portion 121*a* may be formed to be equal to or longer than a length of the magnets 124*a* and 124*b*. Stiffness, an alpha value (a thrust constant or an induced voltage constant of a motor), an alpha value variation of the magnetic spring, and the like, may be determined by the combination of the stator as described above. The stator 120*a* may have a length or a shape determined in various ranges depending on the design of a product to which the corresponding linear motor is applied.

The magnets 124*a* and 124*b* may be disposed so as not to overlap the winding coils 125*b* in a radial direction. Accordingly, a diameter of the motor may be reduced.

The magnets 124*a* and 124*b* may be arranged such that the first magnet 124*a* and the second magnet 124*b* having different polarities are arranged in a reciprocating direction of the mover 120*b*. Accordingly, the magnets 124*a* and 124*b* may be formed of 2-pole magnets in which an N pole and an S pole are formed to have the same length on both sides.

In this embodiment, the magnets 124*a* and 124*b* are illustrated to be provided only in the outer stator 121, but the present disclosure is not limited thereto. For example, the magnets 124*a* and 124*b* may be provided only in the inner stator 122 or may be provided in both the outer stator 121 and the inner stator 122.

The stator 120*a* and the mover 120*b* of the driving unit 120 according to the present embodiment are formed to provide thrust and restoring force for a reciprocating motion of the piston 132. Here, thrust refers to a force for pushing the mover 120*b* in a movement direction, and specifically acts in a direction toward a top dead center during a compression stroke and in a direction toward a bottom dead center during a suction stroke. Meanwhile, restoring force refers to a force for pushing the mover 120*b* toward a reference position (or an initial position). That is, restoring force may be zero at the reference position (0), and may be increased or decreased toward the top dead center or bottom dead center away from the reference position.

As illustrated in FIG. 2, two types of magnetic fluxes may be formed in the stator 120*a* and the mover 120*b* of the present embodiment. One is a magnetic flux A that forms a magnetic path for interlinking the winding coil 125*b*, which serves to generate the thrust described above. That is, one loop may be formed along the outer and inner stator 121 and 122 by a current applied to the winding coil 125*b*, which may generate a thrust for the compression and suction strokes of the mover 120*c*.

The other magnetic flux B is formed to circle around the magnets 124*a* and 124*b*, i.e., the first and second magnets 124*a* and 124*b* and may act to generate a restoring force in this embodiment. The amount of the magnetic flux circling around the magnets 124*a* and 124*b* exposed to the side surface of the pole portion of the stator 120*a* forming the gap 120*c* may be increased as the magnetic core 123*b* of the mover 120*b* deviates from the reference position 0. Thus, the restoring force formed by the magnetic flux circling around the magnets 124*a* and 124*b* tends to increase in absolute as a distance between the magnetic core 123*b* and the reference position 0 increases.

Accordingly, in the driving unit 120 of the present embodiment, a centering force is generated between the stator 120*a* and the mover 120*b*, that is, when the mover 120*b* moves in a magnetic field, a force for storing toward lower magnetic energy (magnetic position energy, magnetic resistance) is generated. This force is a centering force and forms a magnetic resonance spring. Thus, when the mover 120*b* reciprocates by a magnetic force, the mover 120*b* accumulates a force for returning to a central direction by the magnetic resonance spring, and, with this force, the mover 120*b* may continuously reciprocate, while making a resonance motion.

Meanwhile, in the gas lubrication type linear compressor according to the present embodiment, a sealing portion may be formed on an inner circumferential surface of the inner stator 122, i.e., on the inner circumferential surface of the cylinder space 122*a* in order to prevent a refrigerant of the first discharge space 104*a* from leaking to a gap between lamination sheets 127 forming the inner stator 122 in a process of moving to the bearing hole 131*a* forming the gas bearing.

The sealing portion may also be formed by forming a coating layer on the inner circumferential surface of the cylinder space 122*a* with metal powder or ceramic powder or by inserting a sealing member formed as a thin cylindrical body (hereinafter, referred to as a "cylinder support member"). Hereinafter, a case where a sealing portion is formed using a coating layer will be described as an example.

Figure 3:
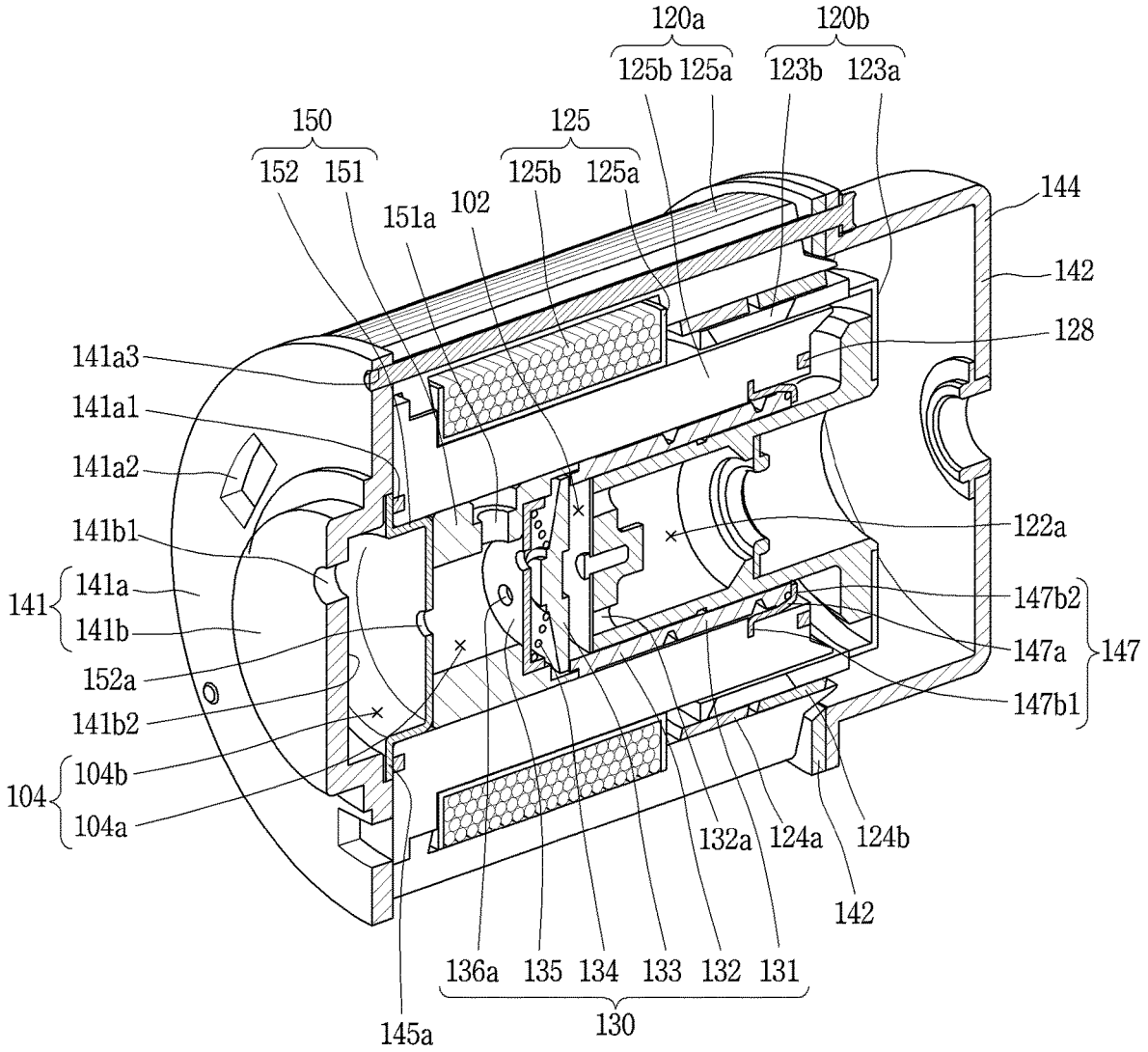
FIG. 3 is a broken cross-sectional perspective view of a compressor main body having an embodiment of a cylinder support member in the linear compressor according to FIG. 1.
Figure 4:
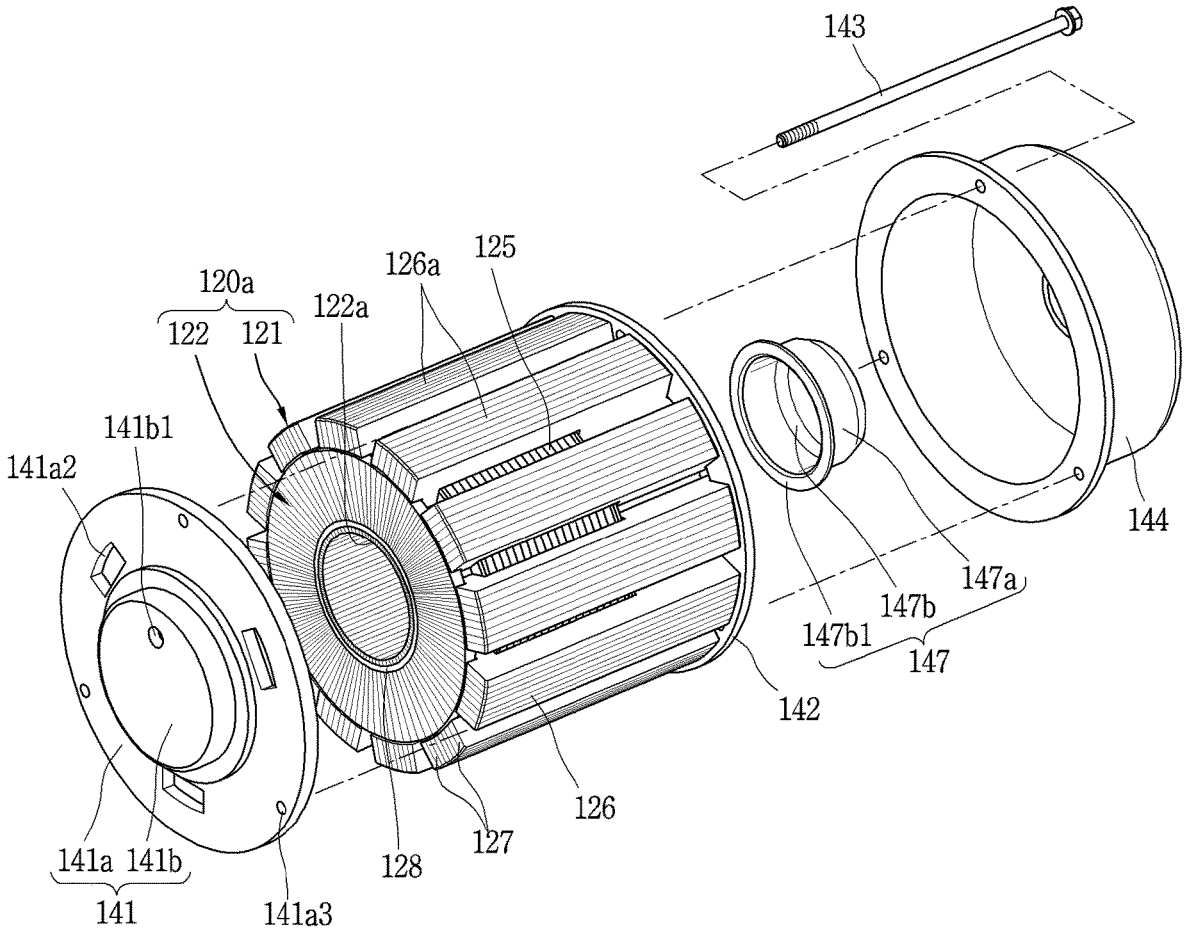
FIG. 4 is an exploded perspective view illustrating a part of the compressor main body in FIG. 3.
Figure 5:
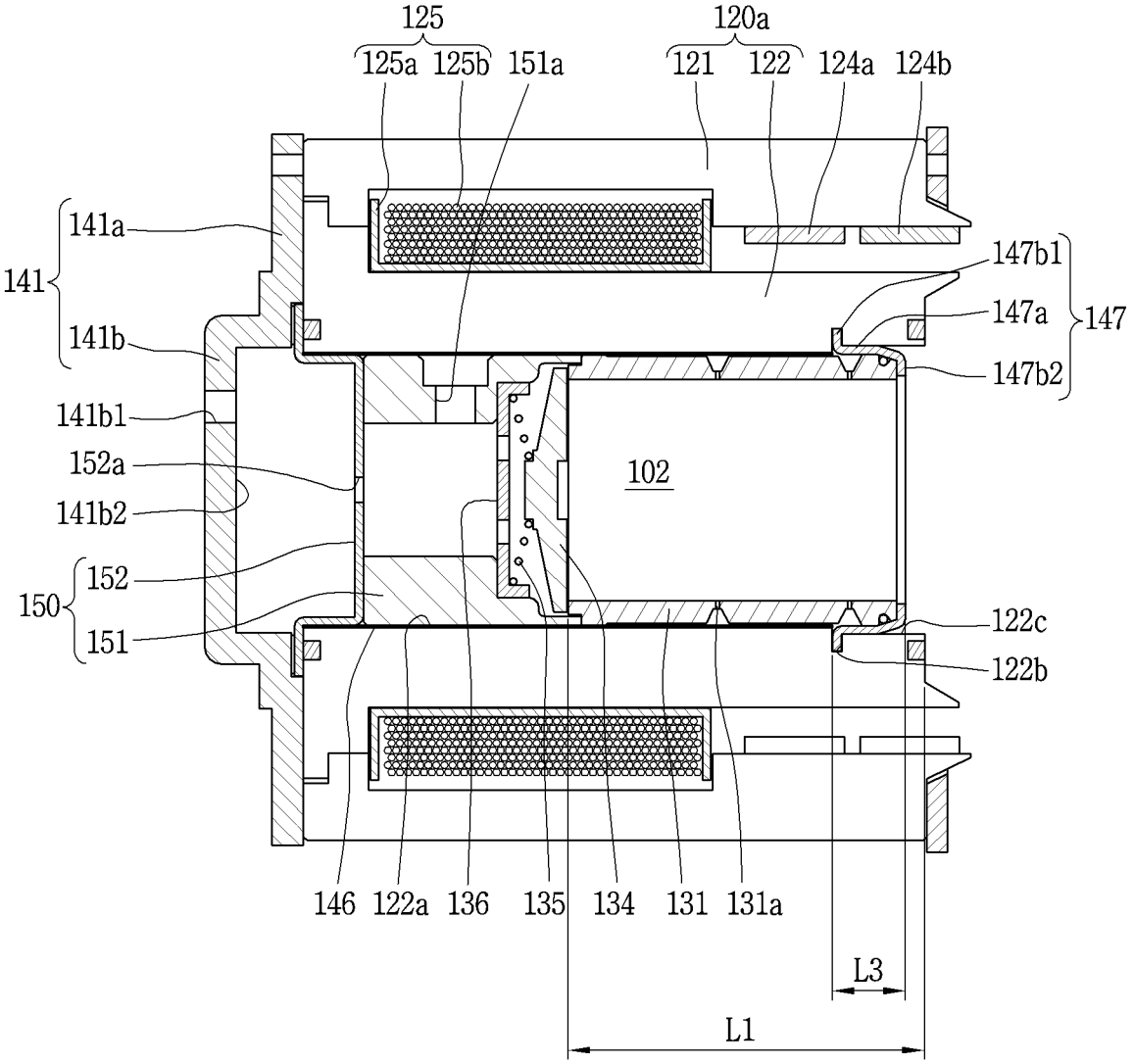
FIG. 5 is an assembled cross-sectional view illustrating a part of the compressor main body illustrated in FIG. 3.
Figure 6:
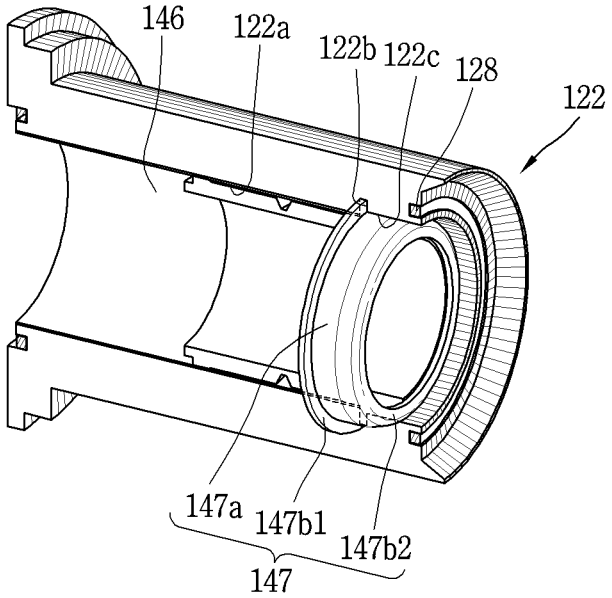
FIG. 6 is a rear assembled perspective view of a frame and the cylinder support member.

FIG. 3 is a broken cross-sectional perspective view of a compressor main body having an embodiment of a cylinder support member in the linear compressor according to FIG. 1, FIG. 4 is an exploded perspective view illustrating a part of the compressor main body in FIG. 3, FIG. 5 is an assembled cross-sectional view illustrating a part of the compressor main body illustrated in FIG. 3, and FIG. 6 is a rear perspective view of the frame and the cylinder support member illustrated in FIG. 5.

Referring to these drawings, a coating layer 146 is formed on an inner circumferential surface of a front side of the cylinder space 122*a*, and a separate cylinder support member 147 supporting a rear end of the cylinder 131 may be inserted into a rear side of the cylinder space 122*a*. The cylinder support member 147 may be formed of a magnetic material as it is in close contact with the inner circumferential surface of the inner stator 122, that is, the inner circumferential surface of the cylinder space 122*a*, but it may be more preferable that the cylinder support member 147 is formed of a non-magnetic material in consideration of motor efficiency.

The cylinder support member 147 may be formed by sheet metal working based on a drawing technique or may be formed using a metal mold. Accordingly, a radial thickness of the cylinder support member 147 may be smaller than an axial thickness of the frame 141.

The cylinder support member 147 may be formed of a thin metal, but in some cases, it may be formed of a rigid plastic material such as engineer plastic.

The cylinder support member 147 may have a cylindrical shape having bent portions at both ends thereof. For example, the cylinder support member 147 may include a first bent portion 147*b*1 formed at a front end of the cylindrical portion 147*a* and extending outwards in a radial direction and a second bent portion 147*b*2 extending inwards in the radial direction.

The first bent portion 147*b*1 may be bent outwards so as to be inserted into the support member fixing recess 122*b* formed on the inner circumferential surface of the inner stator 122, i.e., on the inner circumferential surface of the cylinder space 122*a* and supported in an axial direction. Accordingly, an outer diameter of the first bent portion 147*b*1 may be greater than an outer diameter of the cylinder 131.

The rear end of the cylinder support member 147 forms the second bent portion 147*b*2 extending inwards to support the rear end of the cylinder 131 in the axial direction. The inner diameter of the second bent portion 147*b*2 may be smaller than the inner diameter of the cylinder 131. The second bent portion 147*b*2 is brought into close contact with the rear surface of the cylinder 131 and to provide sealing so that a gas bearing is formed between the outer circumferential surface of the cylinder 131 and the inner circumferential surface of the cylinder support member 147.

An axial length L3 of the cylinder support member 147 may be shorter than an axial length L1 of the cylinder 131. Accordingly, the coating layer 146 described above is formed on the front side of the cylinder 131 to prevent leakage of the refrigerant flowing into the gas bearing.

As illustrated in FIG. 5, a support member receiving recess 122*b* may be formed in a portion of the inner circumferential surface of the inner stator 122 to which the cylinder support member 147 is coupled, such that the cylindrical portion 147*a* of the cylinder support member is inserted thereto. A radial depth of the support member fixing recess 122*b* may be deeper than or equal to the thickness of the cylindrical portion 147*a* of the cylinder support member 147. Accordingly, although the cylinder support member 147 is inserted into the inner circumferential surface of the inner stator 122, that is, the inner circumferential surface of the cylinder space 122*a*, the inner circumferential surface of the cylinder space 122*a* and the inner circumferential surface of the cylinder support member 147 maintain the same inner diameter.

Meanwhile, in the cylinder support member, the first bent portion at the front end of the cylinder support member may be inserted into and supported by the inner circumferential surface of the inner stator within an axial range of the cylinder as in the above embodiment, or, in some cases, the first bent portion may be inserted and coupled to the inner circumferential surface of the inner stator outside the range of the cylinder.

Figure 7:
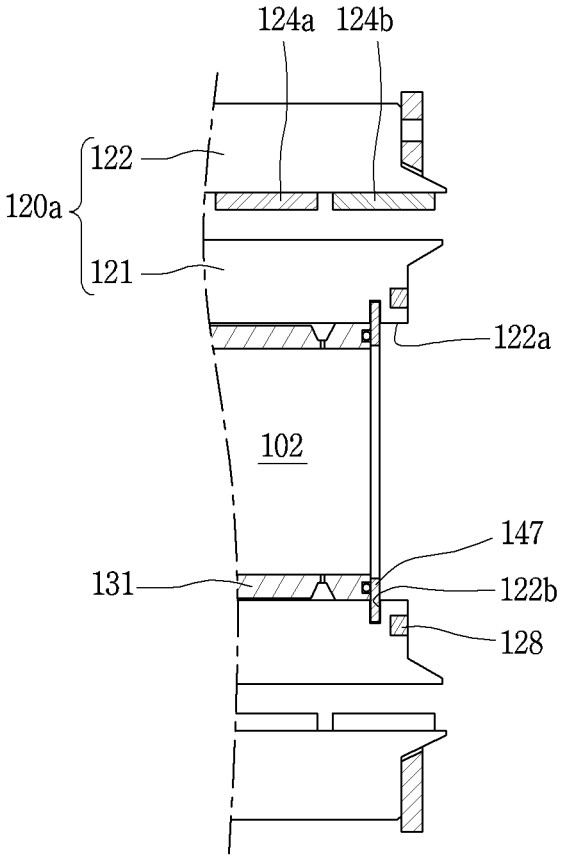
FIG. 7 is a cross-sectional view illustrating another embodiment of a cylinder support member in the compressor according to FIG. 3.

For example, as illustrated in FIG. 7, the cylinder support member 147 may be formed in an annular disc shape without the first bent portion and the second bent portion described above. The outer diameter of the cylinder support member 147 is larger than the outer diameter of the cylinder 131 and the inner diameter of the cylinder support member 147 may be smaller than the outer diameter of the cylinder 131 and larger than the inner diameter of the cylinder 131.

The outer circumferential portion of the cylinder support member 147 may be inserted and fixed to the support member fixing recess 122*b* provided on the inner circumferential surface of the cylinder space 122*a* and the inner circumferential portion of the cylinder support member 147 may be tightly attached to the rear end of the cylinder 131 to support the cylinder 131 in the axial direction.

In this case, since the support member fixing recess 122*b* is formed outside the range of the cylinder 131, it is not necessary to form a support member seating recess on the inner circumferential surface of the inner stator 122, and accordingly, the area of a magnetic path may be increased as much.

Meanwhile, since the rear side of the frame 141 is in contact with the stator 120, the frame 141 may be formed of a material such as aluminum having a certain strength, while having low magnetic permeability, in order to minimize leakage of magnetic flux.

Also, as described above, the frame 141 may have a disc shape to support one side of the stator 120*a* and cover the cylinder space 122*a* of the stator 120*a*.

For example, as illustrated in FIGS. 3 and 4, the frame 141 includes a support portion 141*a* formed at the edge portion to be coupled with one axial side surface of the stator 120*a* and a cover portion 141*b* formed at a central portion to extend as a single body from the inner side of the support portion 141*a* and cover the cylinder space 122*a*.

At least one or more terminal holes 141*a*2 may be formed in the support portion 141*a* so that a terminal portion connecting the winding coil 125*b* to an external power source passes therethrough. At least one (three in the drawing) fastening holes or fastening recesses 141*a*3 may be formed in the support portion 141*a* so as to allow the assembly bolts 143 described above to be fastened thereto.

A third discharge hole 141*b*1 for connecting the loop pipe 112 may be formed in the cover portion 141*b* in a penetrating manner.

As described above, the cover portion 141*b* integrally extends from the inner side of the support portion 141*a*. The cover portion 141*b* protrudes outwards from the stator 120*a* (front side of the stator 120*a*) by a predetermined height as illustrated in FIG. 5. Accordingly, an outer space portion 141*b*2 forming a portion of the second discharge space 104*b* may be formed outside the cylinder space 122*a*, and thus, the volume or number of the second discharge spaces 104*b* may be increased as much to effectively reduce discharge noise.

Although not illustrated in the drawing, a discharge cover having a separate discharge space may be coupled to an outer surface of the frame opposite to the cylinder space. In this case, a third discharge space may communicate with the second discharge space, and the loop pipe may be coupled to the discharge cover and may communicate with the third discharge space.

Meanwhile, the valve stopper 150 may be inserted and fixed in a space formed on a front side of the cylinder 131 in the cylinder space 122*a* to receive the discharge valve 134.

The valve stopper 150 includes a body 151 having a cylindrical shape to form a first discharge space 104*a* and coupled to an inner circumferential surface of the cylinder space 122*a* and a baffle portion 152 coupled to the front side of the body portion 151.

The body portion 151 may be formed of a nonmagnetic material to suppress leakage of magnetic flux. However, since the coating layer formed of an insulating material is formed on the inner circumferential surface of the inner stator 122, it is necessary to form the body portion 151 with a nonmagnetic material. However, the body portion 151 may be formed of an insulating material so as to block transmission of motor heat to the refrigerant, to enhance motor efficiency.

At least one bearing communication hole 151*a* may be formed in the middle of the body portion 151 to guide a portion of the refrigerant, which is discharged to the first discharge space 104*a*, to the gas bearing. Although not shown, a refrigerant introduced to the bearing communication hole 151*a* is guided between the inner circumferential surface of the cylinder space 122*a* and the outer circumferential surface of the cylinder 131 through a passage provided on the outer circumferential surface of the body portion 151, and the refrigerant may be supplied between the cylinder 131 and the piston 132 through the bearing hole 131*a* of the cylinder 131.

At least one baffle portion 152 may be disposed in the axial direction between the body portion 151 and the frame 141 to divide the first discharge space 104*a* and the second discharge space 104*b*. The baffle portion 152 may include at least one second discharge hole 152*a* to allow the refrigerant moving from the first discharge space 104*a* to the second discharge space 104*b* to move toward the loop pipe 112. Accordingly, the valve stopper 150 may serve as a kind of discharge muffler.

Figure 8:
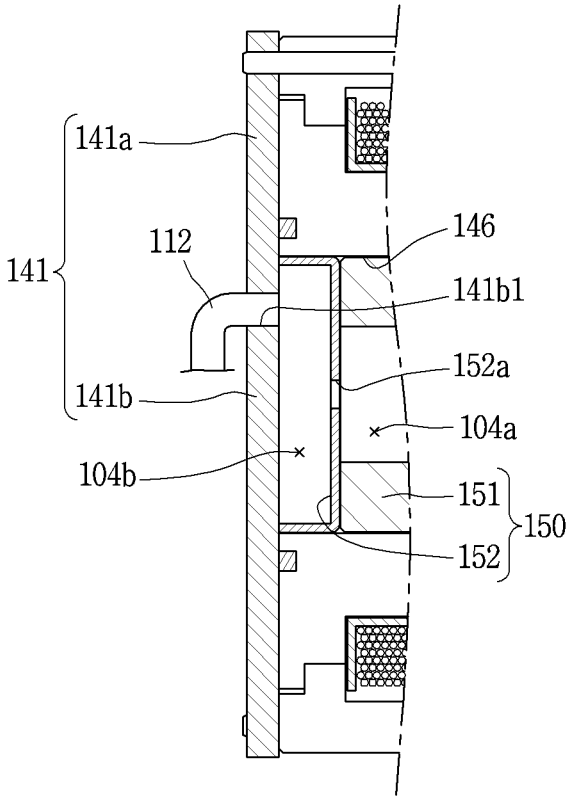
FIG. 8 is a cross-sectional view illustrating another embodiment of a frame in the linear compressor according to FIG. 3.

Meanwhile, another embodiment of the frame in the linear compressor according to the present disclosure will be described. FIG. 8 is a cross-sectional view illustrating another embodiment of the frame in the linear compressor according to FIG. 3.

As illustrated in FIG. 3, the cover portion 141*b* may be formed to be flat and flush with the support portion 141*a*. In this case, since the cover portion 141*b* does not protrude forwards, while the second discharge space 104*b* having a predetermined volume is secured inside the cylinder space 122*a*, the length of the compressor may be reduced as much so as to be compact.

Here, a discharge cover having a separate third discharging space may be provided on an outer surface of the cover portion of the frame. In this case, the third discharge space may communicate with the second discharge space, and the loop pipe may be coupled to the discharge cover and may communicate with the third discharge space.

Figure 9:
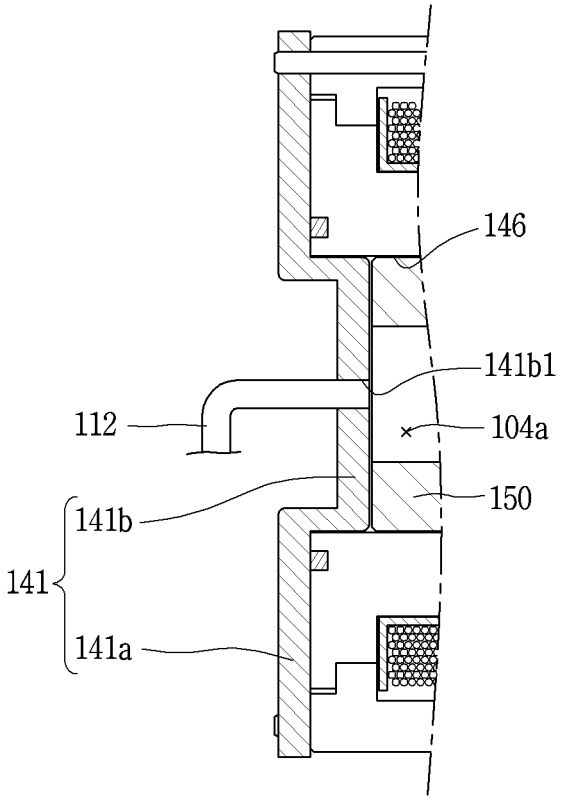
FIG. 9 is a cross-sectional view illustrating another embodiment of a frame in the linear compressor according to FIG. 3.

Meanwhile, another embodiment of the frame may be provided. FIG. 9 is a cross-sectional view illustrating another embodiment of a frame in the linear compressor according to FIG. 1, and FIG. 10 is a cross-sectional view illustrating a state in which a discharge cover is coupled to the frame in FIG. 9.

As illustrated in FIG. 9, the cover portion 141*b* may be depressed by a predetermined depth from the support portion 141*a* toward the cylinder space 122*a*. In this case, the second discharge space may not be formed in the cylinder space 122*a* or may be formed to be small.

Figure 10:
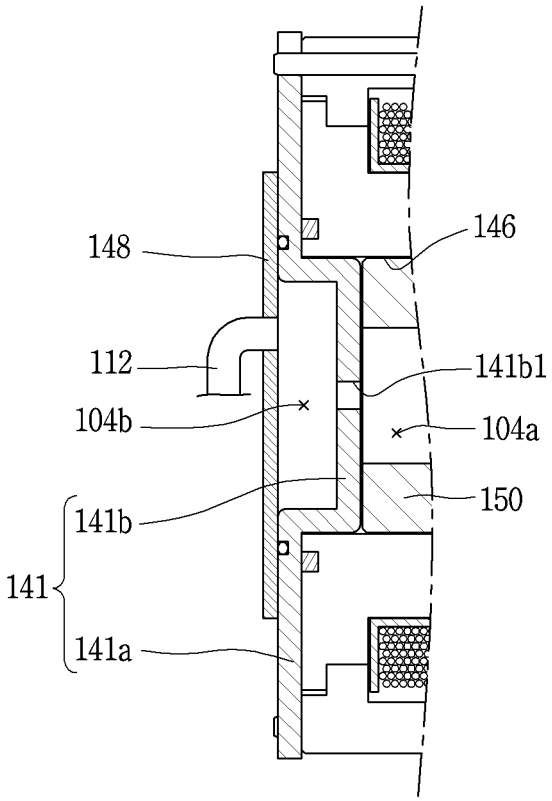
FIG. 10 is a cross-sectional view illustrating a state in which a discharge cover is coupled to a frame in FIG. 9.

Here, as illustrated in FIG. 10, a discharge cover 144 having a separate second discharging space 104*b* may be provided on an outer surface of the cover 141*b* of the frame 141. In this case, the second discharge space 104*b* may communicate with the first discharge space 104*a*, and the loop pipe 112 may be coupled to the discharge cover 144 and may communicate with the second discharge space 104*b*. In particular, in this case, as the cover portion 141*b* of the frame 141 is inserted into the cylinder space 122*a*, the discharge cover 144 may have a shape of a flat plate so that the second discharge space 104*b* may be formed inside a region of the cylinder space 122*a* in order to reduce discharge noise and the size of the compressor.

Meanwhile, in the above-described embodiments, the frame includes the support portion and the cover portion, and the frame and the discharge cover are integrally formed. However, the frame and the discharge cover may be formed separately. In this case, a plurality of discharge covers may be formed, and the plurality of discharge covers may be formed to sequentially and continuously communicate with each other. Alternatively, a single discharge cover may be formed and coupled to the frame.

In the case of a plurality of discharge covers, the cylinder may be formed to have substantially the same axial length as that of the stator, and a front surface of the cylinder and a front surface of the stator may be coupled to be substantially aligned. Therefore, since the discharge space is not formed in the cylinder space, the discharge cover protrudes forwards, and in case where a plurality of discharge spaces are provided, a plurality of discharge covers forming the discharge spaces must be formed.

Meanwhile, in the case of a single discharge cover, an axial length of the cylinder is formed to be smaller than the axial length of the stator as in the embodiment of FIG. 5, so that it may be inserted from the rear end of the stator to the middle. Accordingly, as described above, a discharge space may be formed on the front side of the cylinder space, and thus, although one discharge cover is formed, a plurality of discharge spaces may be formed together with the discharge space formed in the cylinder space.

Figure 11:
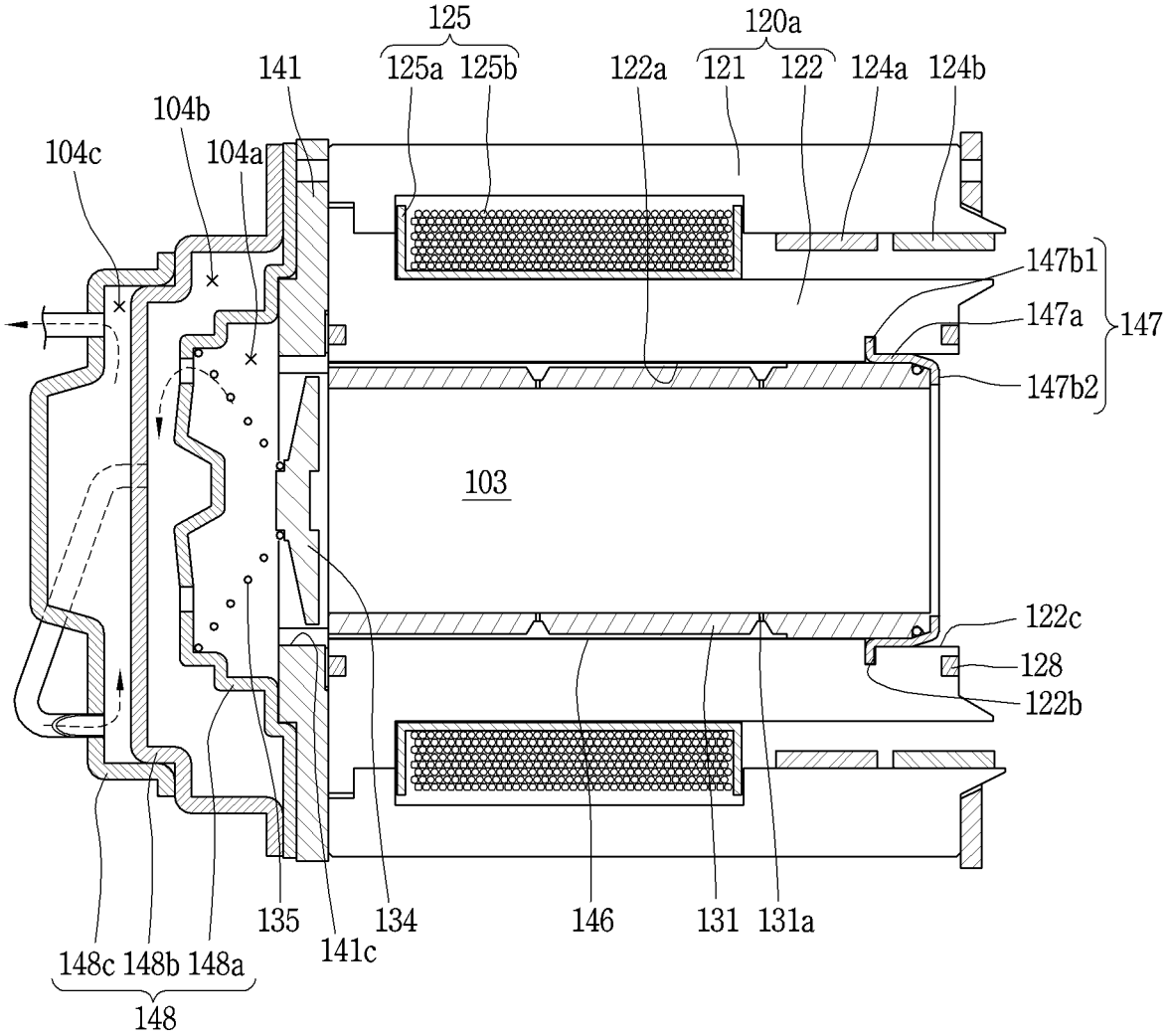
FIG. 11 is a cross-sectional view illustrating another embodiment of a frame and a discharge cover in a linear compressor having a cylinder support member according to FIG. 3.

FIG. 11 is a vertical cross-sectional view illustrating an example in which a plurality of discharge covers are sequentially coupled to a frame when the cylinder is formed to have a length substantially similar to that of the inner stator. As illustrated, the frame 141 has an annular shape having an inner opening 141*c* and a first discharge cover 148*a* is formed to be larger than an inner opening 141*c* of the frame 141 so as to be coupled to a front surface of the frame 141. Also, the second discharge cover 148*b* may be sequentially coupled to the first discharge cover 148*a* and the third discharge cover 148*c* may be sequentially coupled to the second discharge cover 148*b*.

In this case, the front surface of the cylinder 131 may protrude with respect to the front surface of the frame 141 or may be formed at the same position, but when the front surface of the cylinder 131 is substantially aligned with the rear surface of the frame 141 or positioned behind the rear surface of the frame 141, a discharge cover may be positioned in the inner opening 141*c* of the frame 141, and thus, the size of the compressor may be reduced as much.

The inlet of the gas bearing may be formed on the front surface of the frame 141 and communicate with the discharge space 104*a* of the first discharge cover 148*a*, unlike the embodiment described above. Of course, the bearing inlet may communicate with the discharge space 104*b* of the second discharge cover 148*b* or may communicate with the discharge space 104*c* of the third discharge cover 148*c*.

Even when the cylinder 131 has a length similar to that of the inner stator 122 as described above, the frame 141 supports the stator 120*a* and the cylinder support member 147 supports the cylinder 131, obtaining the same effect that the structure of the frame 141 may be simplified and reduced in size to reduce material cost. Also, since the plurality of discharge covers 148 are formed, discharge noise of the compressor may be lowered and, since the discharge space is positioned outside the motor, a temperature of the discharged refrigerant may be lowered to increase compressor efficiency.

However, in this embodiment, if the length of the cylinder is increased to be longer than that of the previous embodiment described above, the length of the piston is also relatively increased. However, as the length of the piston is increased, a length for sealing between the cylinder and the piston is increased, so that the behavior of the piston may be stabilized and leakage of the refrigerant in the compression space may be reduced.

Meanwhile, in the gas lubrication type linear compressor according to the present embodiment, a sealing portion may be formed on an inner circumferential surface of the inner stator 122, i.e., on the inner circumferential surface of the cylinder space 122*a* to prevent leakage of the refrigerator from the first discharge space 104*a* or the refrigerant moving to the bearing hole 151*a* to a gap between the lamination sheets 127 forming the inner stator 122.

The sealing portion may also be formed by forming a coating layer (not shown) with metal powder or ceramic powder on an inner circumferential surface of the cylinder space 122*a* or using a cylinder support member. Hereinafter, a case where the sealing portion is formed using a cylinder support member will be described as an example.

Figure 12:
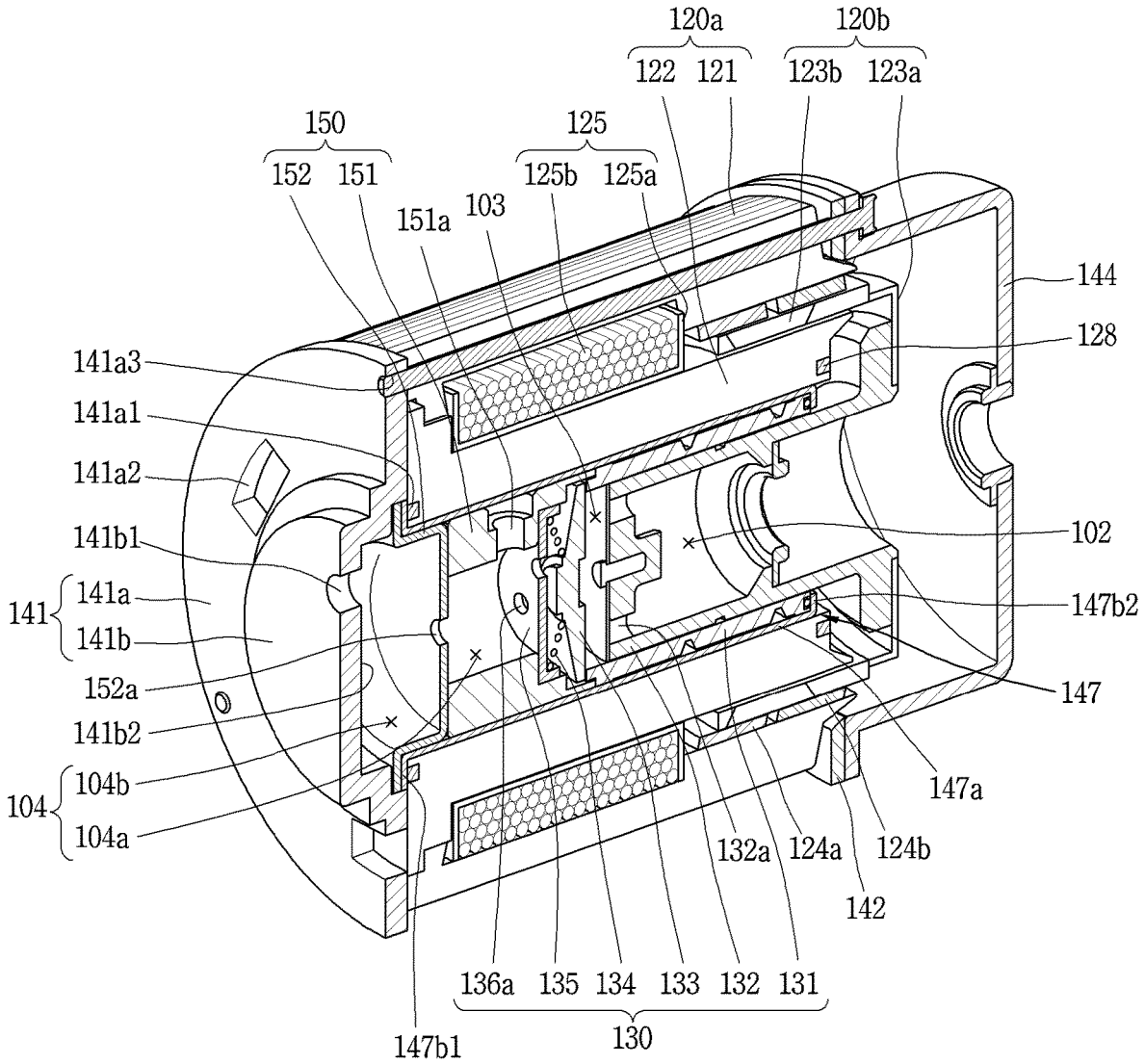
FIG. 12 is a broken cross-sectional perspective view of a compressor main body having another embodiment of a cylinder support member in the linear compressor according to FIG. 1.
Figure 13:
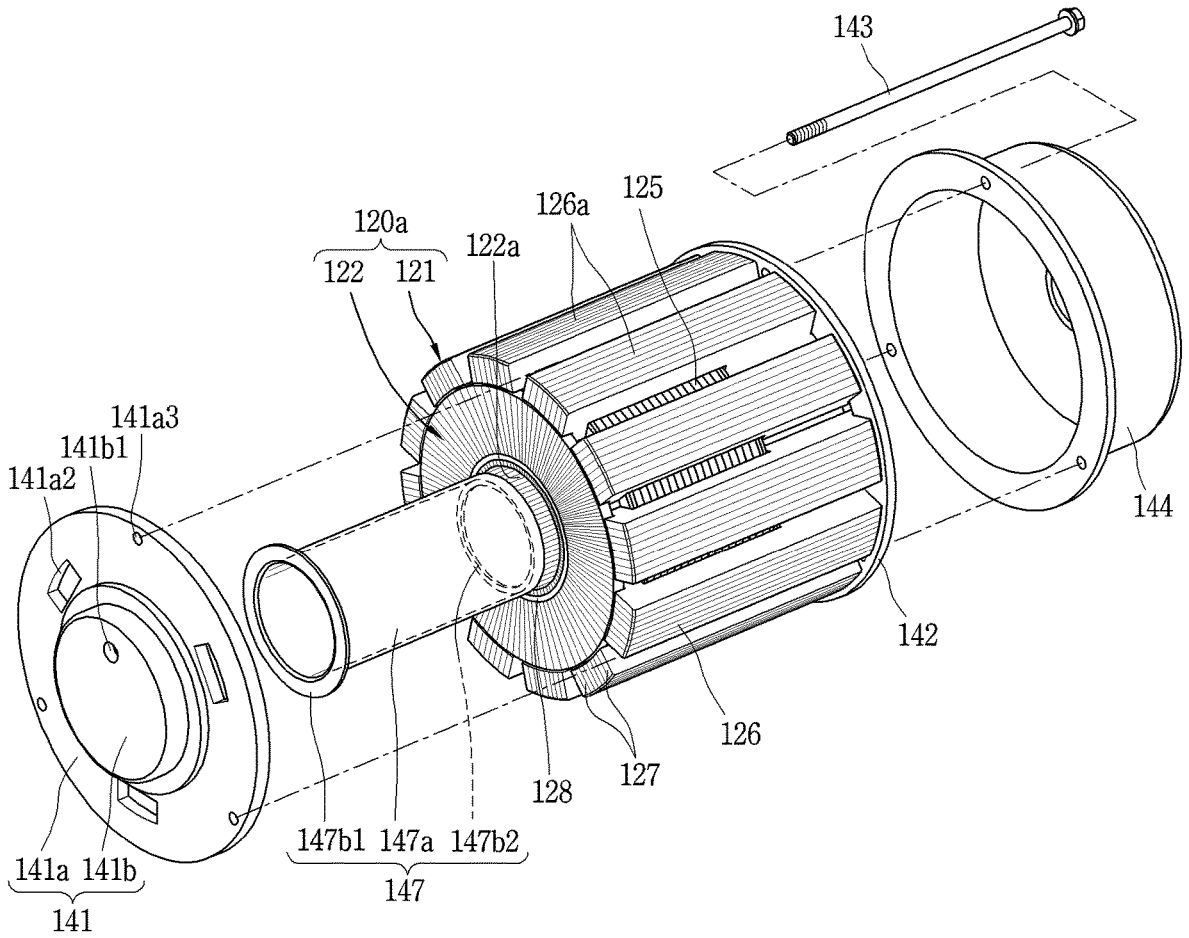
FIG. 13 is an exploded perspective view illustrating a part of the compressor main body in FIG. 12.
Figure 14:
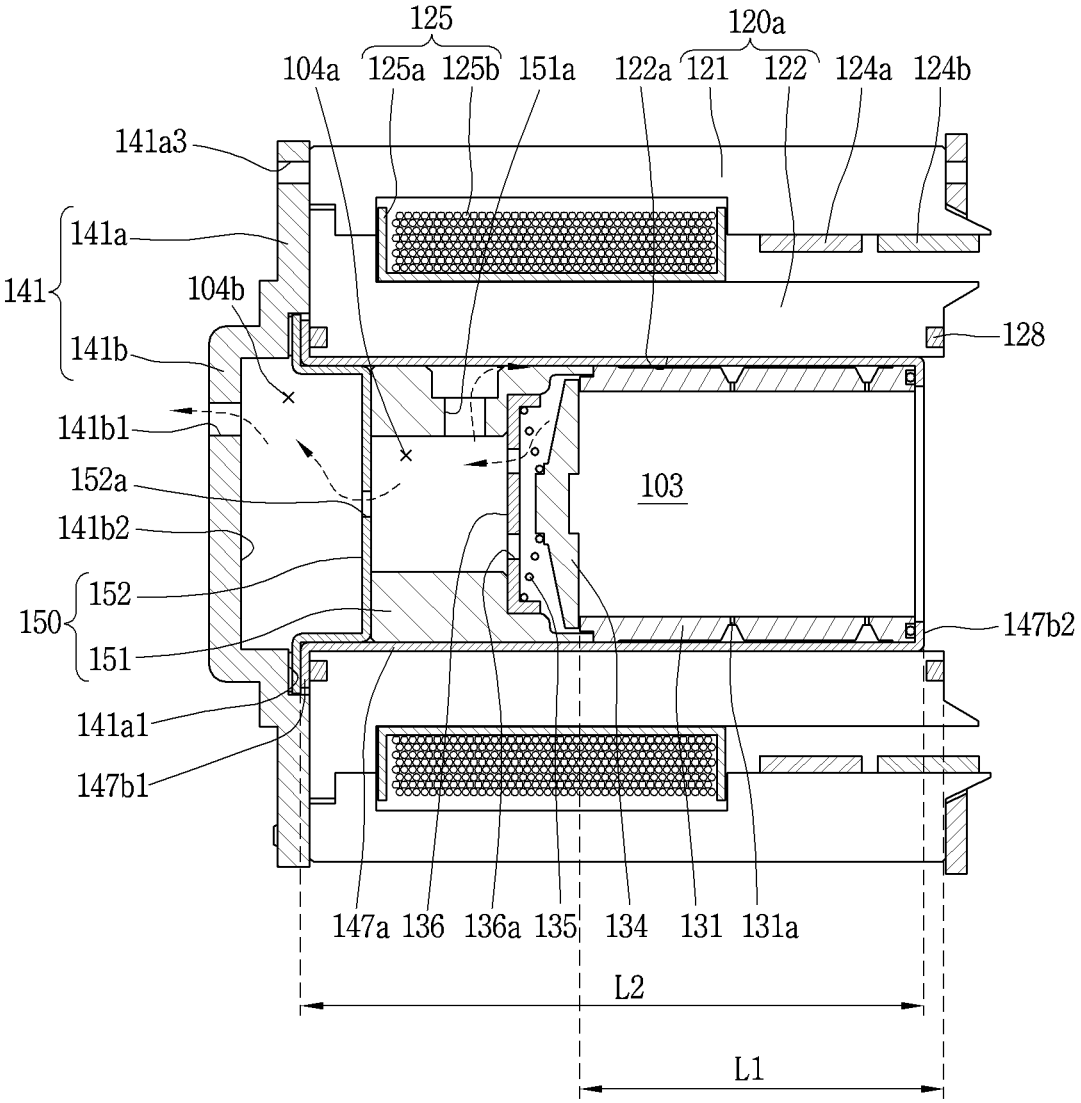
FIG. 14 is an assembled cross-sectional view illustrating a part of the compressor main body illustrated in FIG. 12.
Figure 15:
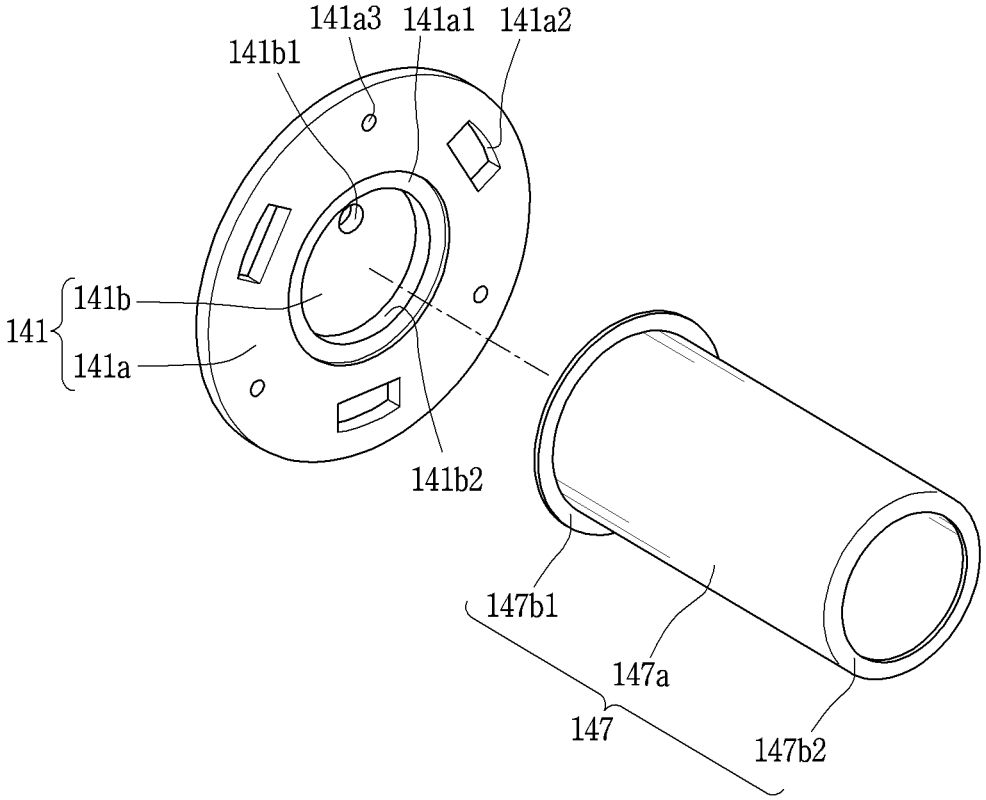
FIG. 15 is a rear exploded perspective view of a frame and the cylinder support member.

FIG. 12 is a broken cross-sectional perspective view of a compressor main body having another embodiment of a cylinder support member in the linear compressor according to FIG. 1, FIG. 13 is an exploded perspective view illustrating a part of the compressor main body in FIG. 12, FIG. 14 is an assembled cross-sectional view illustrating a part of the compressor main body illustrated in FIG. 12, and FIG. 15 is a rear exploded perspective view of a frame and the cylinder support member.

Referring to these drawings, the cylinder support member 147 may have a cylindrical shape and may be inserted into the inner circumferential surface of the inner stator 122. The cylinder support member 147 may be formed of a magnetic material as it is in close contact with the inner circumferential surface of the cylinder space 122*a*, but it may be more preferable that the cylinder support member 147 is formed of a nonmagnetic material in consideration of motor efficiency.

The cylinder support member 147 may be formed by sheet metal working by a drawing technique or may be formed by using a metal mold. Accordingly, a thickness of the cylinder support member 147 in a radial direction may be thinner than an axial thickness of the frame 141.

The cylinder support member 147 may be formed of a thin metal, but in some cases, it may be formed of a rigid plastic material such as engineer plastic.

A first bent portion 147*b*1 extending outwards may be formed at a front end of the cylindrical portion 147*a* of the cylinder support member 147 and may be axially supported by a front surface of the inner stator 122. The first bent portion 147*b*1 may be pressed on a rear surface of the frame 141 to be described later or may be inserted into and supported by a support member insertion recess 141*a*1 provided on the rear surface of the frame 141 as illustrated in FIGS. 12 and 15. Accordingly, as illustrated in FIG. 14, a front side of the cylinder support member 147 protrudes with respect to the front side of the inner stator 12 and an axial length L2 of the cylinder support member 147 may be slightly greater than an axial length L1 of the inner stator 122. Also, in this case, the axial length L2 of the cylinder support member 147 may be longer than at least the axial length of the cylinder 131.

Figure 16:
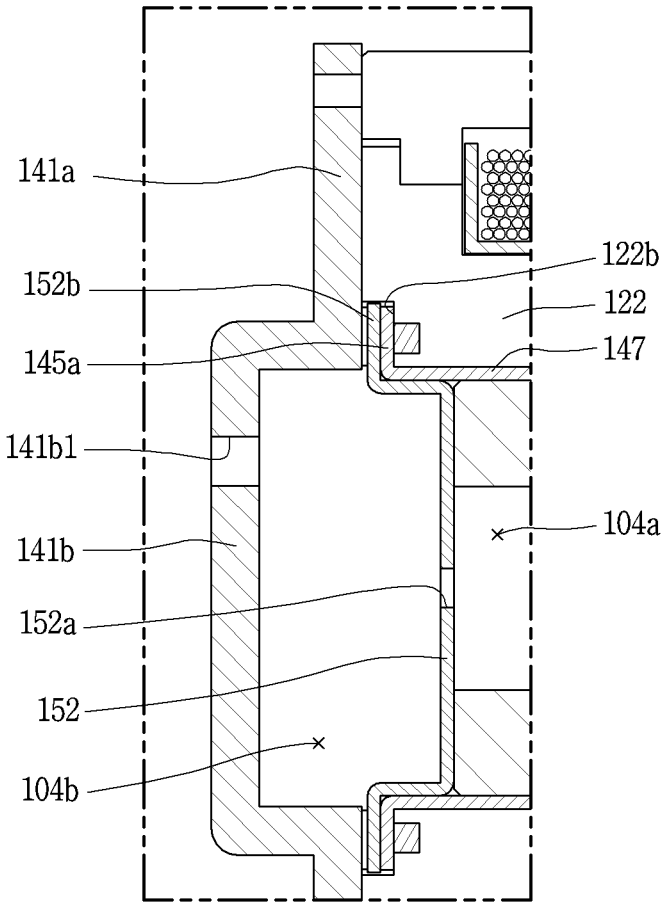
FIG. 16 is a cross-sectional view illustrating a coupling relationship between a frame, an inner stator, and a cylinder support member in FIG. 14.

However, the first bent portion 147*b*1 of the cylinder support member 147 may be inserted into the front side of the inner stator 122 and supported. For example, as illustrated in FIG. 16, a support member fixing recess 122*b* may be formed on the front side surface of the inner stator 122 and the first bent portion 147*b*1 of the cylinder support member 147 may be inserted into the support member fixing recess 122*b*. In this case, a depth of the support member fixing recess 122*b* may be a depth into which the bent portion 152*b* provided on the front side of the baffle portion 152 (to be described later) may be inserted together, as well as the first bent portion 147*b*1 of the cylinder support member 147. Accordingly, it is not necessary to form a separate support member insertion recess on the rear surface of the frame 141, allowing the frame 141 to be easily processed.

The rear end of the cylinder support member 147 may have a second bent portion 147*b*2 extending inwards to support the rear end of the cylinder 131 in the axial direction. The second bent portion 147*b*2 is in close contact with the rear surface of the cylinder 131 to perform sealing so that a gas bearing is formed between the outer circumferential surface of the cylinder 131 and the inner circumferential surface of the cylinder support member 147.

Meanwhile, the cylinder support member may be supported on the front surface of the inner stator at the front end of the front end thereof as in the above embodiment, or, in some cases, the cylinder support member may be inserted into and coupled to the inner circumferential surface of the cylinder space, i.e., the inner circumferential surface of the inner stator.

Figure 17:
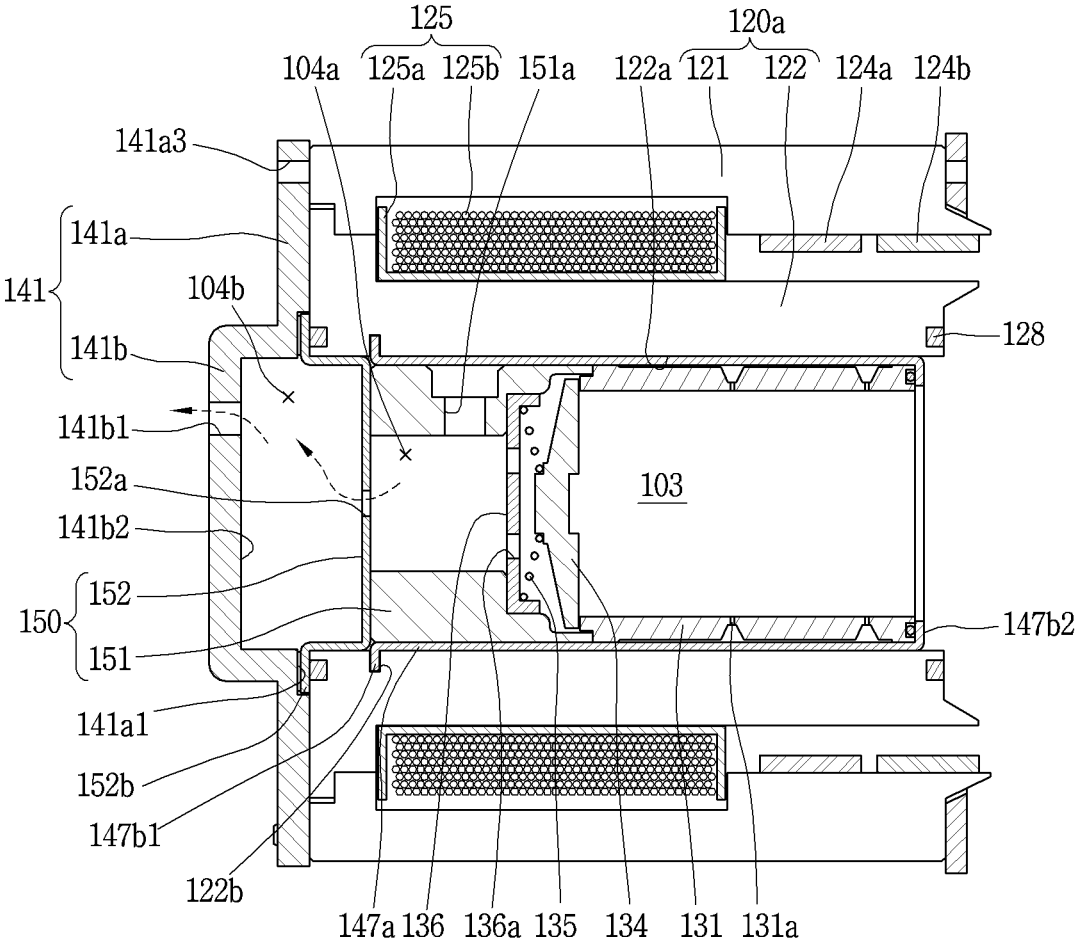
FIG. 17 is a cross-sectional view illustrating another embodiment of a cylinder support member in the linear compressor according to FIG. 12.

For example, as illustrated in FIG. 17, an annular support member fixing recess 122*b* is formed on the inner circumferential surface of the inner stator 122, and the first bent portion 147b1 of the cylinder support member 147 may be inserted to be coupled to the support member fixing recess 122b. In this case, in consideration of strength of the cylinder support member 147, it is preferable that each stator core of the inner stator 122 is stacked on the cylinder support member 147, rather than that the cylinder support member 147 is inserted after the inner stator 122 is stacked. Here, by stacking each stator core such that the support member fixing recess 122b of the inner stator 122 is inserted into the first bent portion 147b1 of the cylinder support member 147, the first bent portion 147b1 of the cylinder support member 147 may be collectively coupled to the support member fixing recesses 122b of the inner stator 122.

A baffle portion 152 of a valve stopper 150, which will be described later, may be inserted and coupled to a front side space of the cylinder support member 147. Accordingly, since only the front side bent portion 152b of the baffle portion 152, which will be described later, is inserted into the support member insertion recess 141a1 formed on the rear surface of the frame 141, the depth of the support member insertion recess 141a1 may be reduced, or the support member insertion recess itself may not be necessary, depending on a fixing method of the baffle portion 152. Then, the shape of the frame 141 may be further simplified.

As the outer circumferential surface of the baffle portion 152 is in direct contact with and fixed to the inner circumferential surface of the cylinder space 122a, i.e., the inner circumferential surface of the inner stator 122, the volume of the second discharge space 104b formed by the baffle portion 152 may be increased as much to increase a noise reduction effect.

Since a rear side surface of the frame 141 is in contact with the stator 120, the frame 141 may be formed of a material such as aluminum which has a certain strength, while having low magnetic permeability, to minimize leakage of magnetic flux.

The frame 141 may have a disc shape so as to support one side surface of the stator 120a and cover the cylinder space 122a of the stator 120a as described above.

For example, as illustrated in FIGS. 12 and 13, the frame 141 includes a support portion 141a formed at the edge portion to be engaged with one axial side surface of the stator 120a and a cover portion 141b formed at a central portion to extend as one body from an inner side of the support portion 141a and cover the cylinder space 122a.

At least one or more terminal holes 141a2 may be formed in the support portion 141a to allow a terminal portion connecting the winding coil 125b to an external power source to pass therethrough. Also, at least one (three in the drawing) fastening hole or fastening recess 141a3 may be formed in the support portion 141a to allow the assembly bolts 143 described above to be fastened thereto.

A third discharge hole 141b1 connecting the loop pipe 112 may be formed to penetrate through the cover portion 141b.

As described above, the cover portion 141b integrally extends from the inside of the support portion 141a. The cover portion 141b by protrude toward the outside (front side) of the stator 120a by a predetermined height. Accordingly, an outer space portion 141b2 forming a portion of the second discharge space 104b may be formed outside the cylinder space 122a, and accordingly, the volume or the number of the second discharge space 104b may be increased as much or as much, effectively reducing discharge noise.

Although not illustrated in the drawing, a discharge cover having a separate discharge space may be coupled to the opposite side of the cylinder space, i.e., on an outer surface of the frame. In this case, the third discharge space may communicate with the second discharge space, and the loop pipe may be coupled to the discharge cover and communicate with the third discharge space.

Meanwhile, the valve stopper 150 may be inserted and fixed in the space formed on the front side of the cylinder 131 in the cylinder space 122a to receive the discharge valve 134.

The valve stopper 150 includes a body 151 having a cylindrical shape to form a first discharge space 104a and coupled to an inner circumferential surface of the cylinder space 122a and a baffle portion 152 coupled to the front side of the body portion 151.

The body portion 151 may be formed of a nonmagnetic material to suppress leakage of magnetic flux. However, since the coating layer formed of an insulating material is formed on the inner circumferential surface of the inner stator 122 or the separate cylinder support member 147 is inserted, the body portion 151 may not need to be formed of a non-magnetic material. However, in order to block transmission of heat from a motor to the refrigerant, the body portion 151 may be formed of an insulating material to increase motor efficiency.

At least one bearing communication hole 151a may be formed in the middle of the body portion 151 to guide a portion of the refrigerant, which is discharged to the first discharge space 104a, to the gas bearing. Although not shown, a refrigerant introduced to the bearing communication hole 151a may be guided between the inner circumferential surface of the cylinder space 122a (or the inner circumferential surface of the cylinder support member) and the outer circumferential surface of the cylinder 131 through a passage provided on the outer circumferential surface of the body portion 151, and the refrigerant may be supplied between the cylinder 131 and the piston 132 through the bearing hole 131a of the cylinder 131.

At least one baffle portion 152 may be disposed in the axial direction between the body portion 151 and the frame 141 to divide the first discharge space 104a and the second discharge space 104b. The baffle portion 152 may include at least one second discharge hole 152a to allow the refrigerant moving from the first discharge space 104a to the second discharge space 104b to move toward the loop pipe 112. Accordingly, the valve stopper 150 may serve as a kind of discharge muffler.

Figure 18:
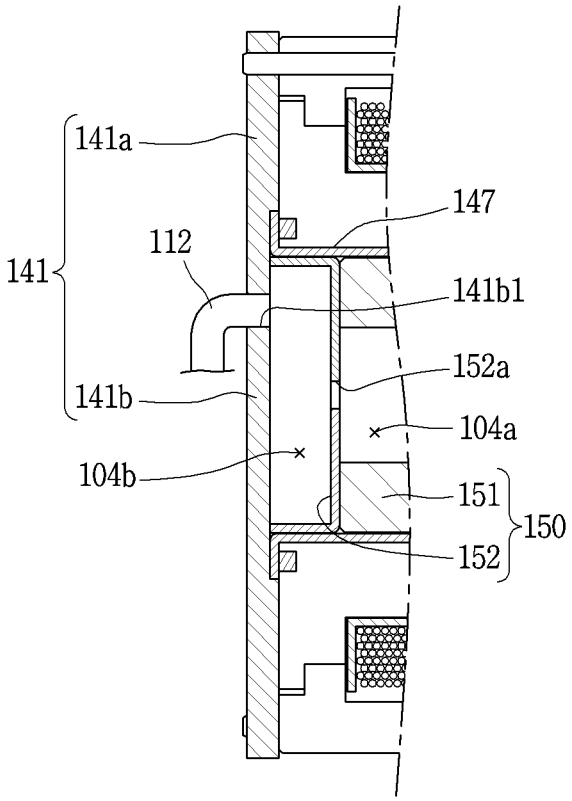
FIG. 18 is a cross-sectional view illustrating another embodiment of a frame in the linear compressor according to FIG. 12.

Meanwhile, another embodiment of the frame in the linear compressor according to the present disclosure will be described. FIG. 18 is a cross-sectional view illustrating another embodiment of the frame in the linear compressor according to FIG. 12.

As illustrated, the cover portion 141b may be formed to be flat and flush with the support portion 141a. In this case, since the cover portion 141b does not protrude forwards, while the second discharge space 104b having a predetermined volume is secured inside the cylinder space 122a, the length of the compressor may be reduced as much so as to be compact.

Here, a discharge cover having a separate third discharging space may be provided on an outer surface of the cover portion of the frame. In this case, the third discharge space may communicate with the second discharge space, and the loop pipe may be coupled to the discharge cover and may communicate with the third discharge space.

Figure 19:
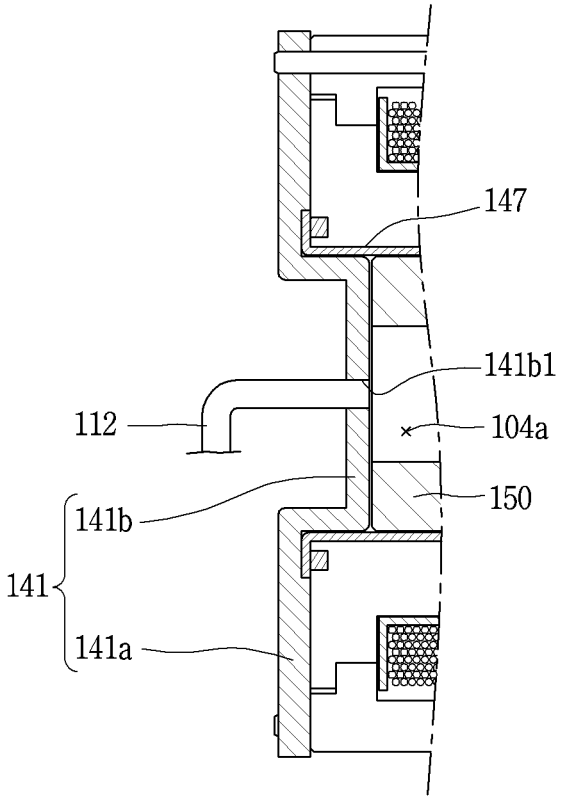
FIG. 19 is a cross-sectional view illustrating another embodiment of a frame in the linear compressor according to FIG. 12.

Meanwhile, another embodiment of the frame may be provided. FIG. 19 is a cross-sectional view illustrating another embodiment of a frame in the linear compressor according to FIG. 12, and FIG. 20 is a cross-sectional view illustrating a state in which a discharge cover is coupled to the frame in FIG. 19.

As illustrated in FIG. 19, the cover portion 141*b* may be depressed by a predetermined depth from the support portion 141*a* toward the cylinder space 122*a*. In this case, the second discharge space may not be formed in the cylinder space 122*a* or may be formed to be small.

Figure 20:
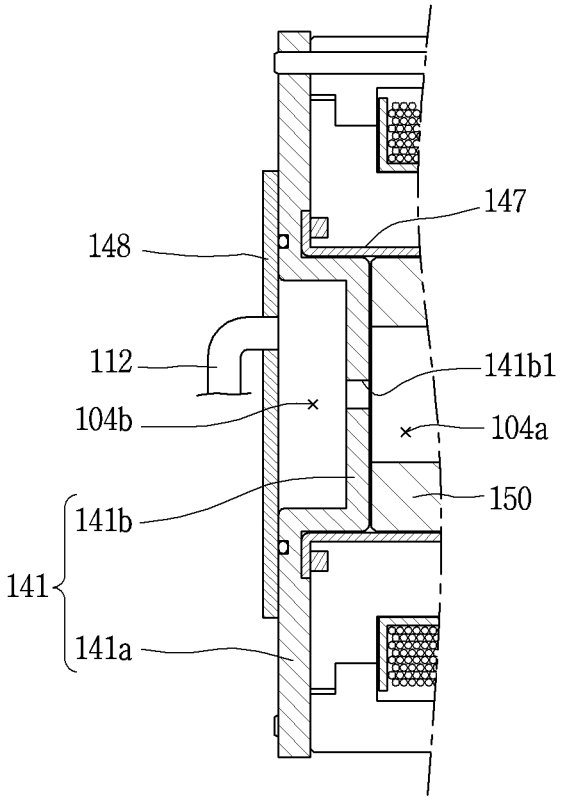
FIG. 20 is a cross-sectional view illustrating a state in which a discharge cover is coupled to a frame in FIG. 19.

Here, as illustrated in FIG. 20, a discharge cover 148 having a separate second discharging space 104*b* may be provided on an outer surface of the cover 141*b* of the frame 141. In this case, the second discharge space 104*b* may communicate with the first discharge space 104*a*, and the loop pipe 112 may be coupled to the discharge cover 148 and may communicate with the second discharge space 104*b*. In particular, in this case, as the cover portion 141*b* of the frame 141 is inserted into the cylinder space 122*a*, the discharge cover 148 may have a shape of a flat plate so that the second discharge space 104*b* may be formed inside a region of the cylinder space 122*a* in order to reduce discharge noise and the size of the compressor.

Meanwhile, the frame and the discharge cover may be formed separately. In this case, a plurality of discharge covers may be formed, and the plurality of discharge covers may be formed to sequentially and continuously communicate with each other. Alternatively, a single discharge cover may be formed and coupled to the frame.

In the case of a plurality of discharge covers, the cylinder may be formed to have substantially the same axial length as that of the cylinder support member, and a front surface of the cylinder and a front surface of the cylinder support member may be coupled to be substantially aligned. Therefore, since the discharge space is not formed in the cylinder space, the discharge cover protrudes forwards, and in case where a plurality of discharge spaces are provided, a plurality of discharge covers forming the discharge spaces must be formed.

Meanwhile, in the case of a single discharge cover, an axial length of the cylinder is formed to be smaller than the axial length of the cylinder support member as in the embodiment of FIG. 5, so that it may be inserted from the rear end of the cylinder support member to the middle. Accordingly, as described above, a discharge space may be formed on the front side of the cylinder, and thus, although one discharge cover is formed, a plurality of discharge spaces may be formed together with the discharge space formed in the cylinder support member.

Figure 21:
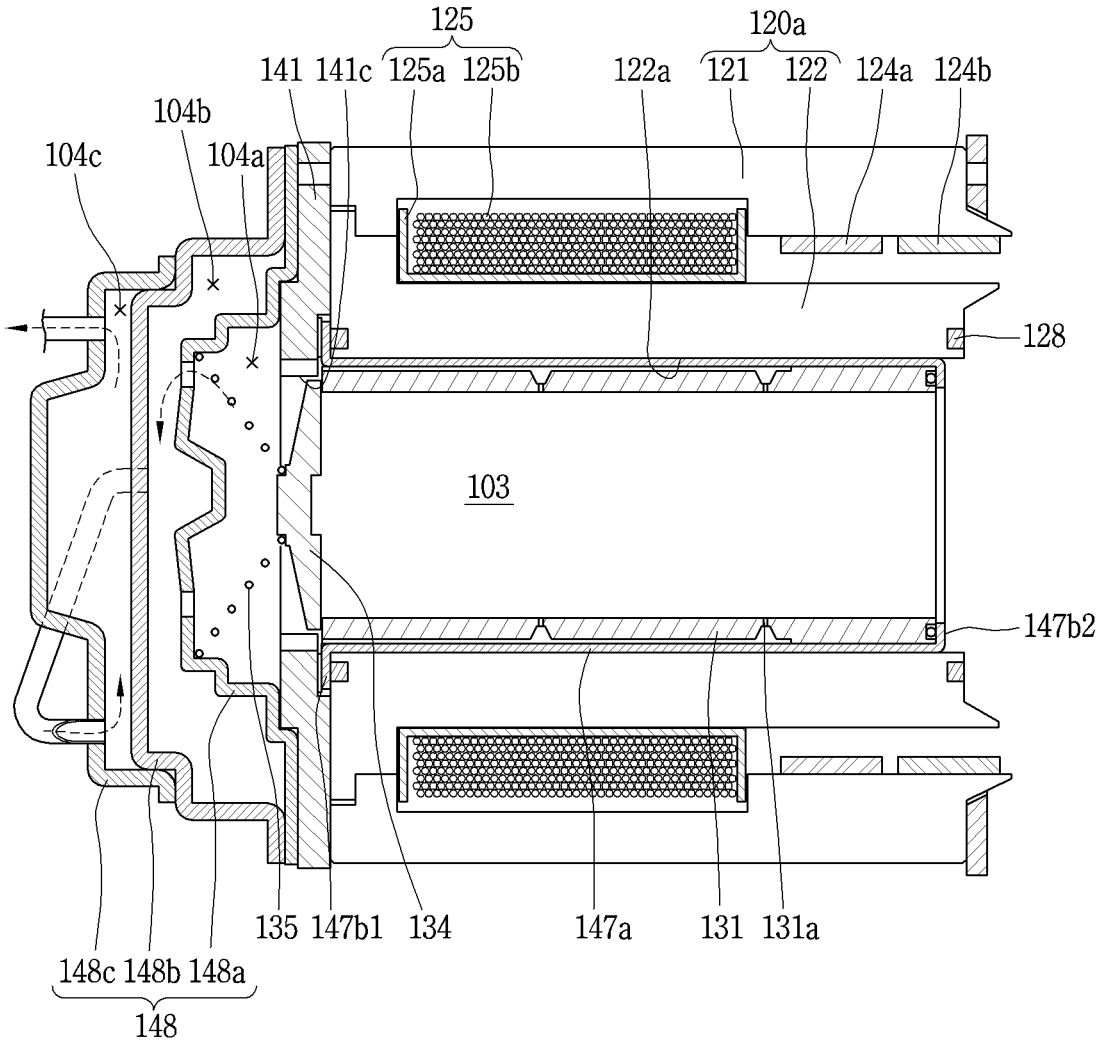
FIG. 21 is a cross-sectional view illustrating another embodiment of a frame and a discharge cover in a linear compressor having a cylinder support member according to FIG. 12.

FIG. 21 is a vertical cross-sectional view illustrating an example in which a plurality of discharge covers are sequentially coupled to a frame when the cylinder is formed to have a length substantially similar to that of the cylinder support member. As illustrated, the frame 141 has an annular shape having an inner opening 141*c* and a first discharge cover 148*a* is formed to be larger than an inner opening 141*c* of the frame 141 so as to be coupled to a front surface of the frame 141. Also, the second discharge cover 148*b* may be sequentially coupled to the first discharge cover 148*a* and the third discharge cover 148*c* may be sequentially coupled to the second discharge cover 148*b*.

In this case, the front surface of the cylinder 131 may protrude with respect to the front surface of the frame 141 or may be formed at the same position, but when the front surface of the cylinder 131 is substantially aligned with the rear surface of the frame 141 or positioned behind the rear surface of the frame 141, a discharge cover may be positioned in the inner opening 141*c* of the frame 141, and thus, the size of the compressor may be reduced as much.

The inlet of the gas bearing may be formed on the front surface of the frame 141 and communicate with the discharge space 104*a* of the first discharge cover 148*a*, unlike the embodiment described above. Of course, the bearing inlet may communicate with the discharge space 104*b* of the second discharge cover 148*b* or may communicate with the discharge space 104*c* of the third discharge cover 148*c*.

Even when the cylinder 131 has a length similar to that of the cylinder support member 147 or the inner stator 122 as described above, the frame 141 supports the stator 120*a* and the cylinder support member 147 supports the cylinder 131, obtaining the same effect that the structure of the frame 141 may be simplified and reduced in size to reduce material cost. Also, since the plurality of discharge covers 148 are formed, discharge noise of the compressor may be lowered and, since the discharge space is positioned outside the motor, a temperature of the discharged refrigerant may be lowered to increase compressor efficiency.

However, in this embodiment, if the length of the cylinder is increased to be longer than that of the previous embodiment described above, the length of the piston is also relatively increased. However, as the length of the piston is increased, a length for sealing between the cylinder and the piston is increased, so that the behavior of the piston may be stabilized and leakage of the refrigerant in the compression space may be reduced.

Meanwhile, in the above-described embodiments, a support spring formed of a compression coil spring is provided between the casing and the compressor main body to support the compressor main body relative to the casing. However, as described above, the support spring may not necessarily have to be a coil spring. For example, the support spring may be a leaf spring.

When the compressor main body is supported using the support spring formed of a coil spring or a leaf spring as described above, vibration generated in the compressor main body is absorbed by the support spring. Then, vibration of the compressor may be attenuated to realize a low vibration low noise compressor.

However, when a support spring is provided, a separate support structure for coupling the support spring is required. This causes complication of assembly of the compressor, increases a material cost, and requires a separate space inside the compressor to increase the size of the compressor.

Further, as the compressor main body is supported by the spring, a phenomenon in which the compressor main body sags in a gravity direction due to the spring characteristics may occur. This problem may be more serious in the case of a leaf spring. As a result, the casing and the compressor main body may collide with each other when the compressor is driven, and thus, a separate fixing member such as a stopper is provided to prevent a collision between the casing and the compressor main body. This causes the structure of the compressor to become more complicated.

In view of this, in the present embodiment, instead of excluding the support spring, a first guide may be provided in the compressor main body and a second guide slidably coupled with the first guide may be provided. Accordingly, since the first guide and the second guide are slidably coupled in the axial direction, vibration of the compressor main body in the axial direction with respect to the casing may be guaranteed and the compressor main body may be firmly supported in the radial direction with respect to the casing, whereby the compressor main body is prevented from sagging.

Figure 22:
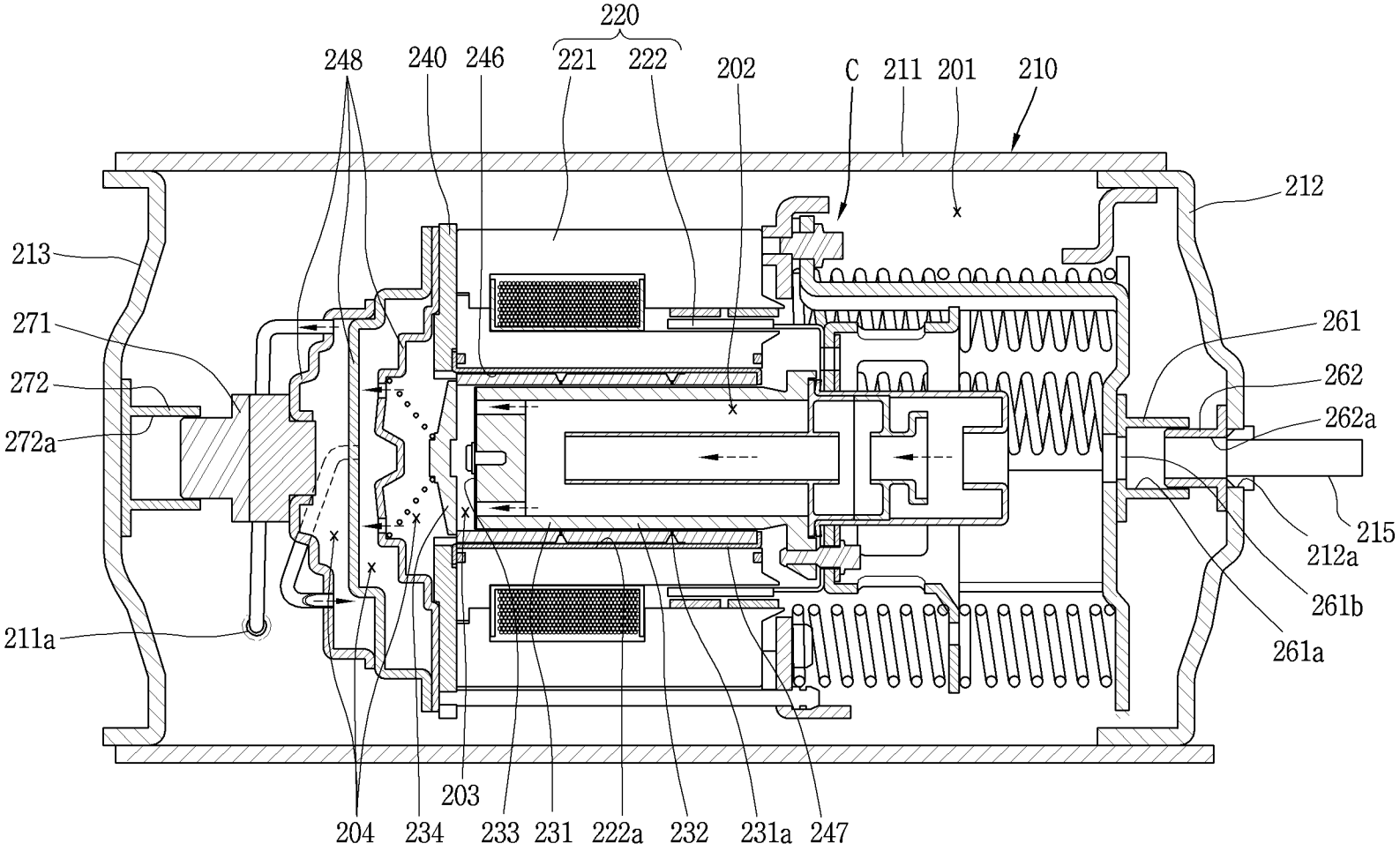
FIG. 22 is a cross-sectional view illustrating another embodiment of a linear compressor according to the present disclosure.
Figure 23:
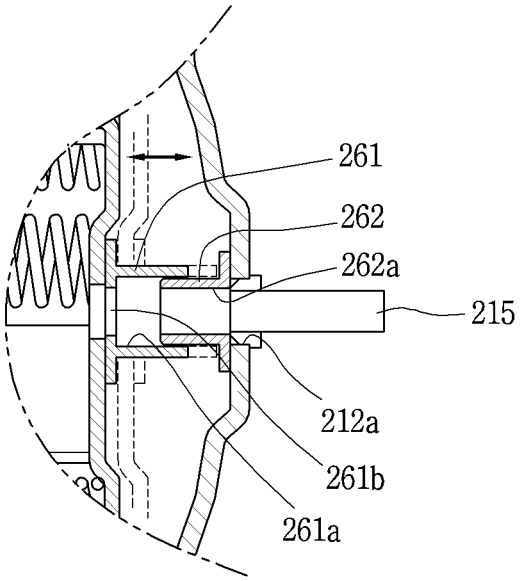
FIG. 23 is a cross-sectional view illustrating an operation of a first guide and a second guide on a rear side in FIG. 22.

Hereinafter, the parts not described in the above-described embodiments, for example, the first guide and the second guide, will be mainly described. FIG. 22 is a cross-sectional view illustrating another embodiment of a linear compressor according to the present disclosure, and FIG. 23 is a cross-sectional view illustrating an operation of the first guide and the second guide on the rear side in FIG. 22.

As illustrated, a casing 210 of a linear compressor according to the present embodiment includes a shell 211 having a cylindrical shape extending substantially in a transverse direction with both ends open, a first shell cover 212 coupled to a rear side of the shell 211 and a second shell cover 213 coupled to a front side.

The casing 210 is positioned to lie down in the transverse direction, and in the drawing, the first shell cover 212 may be coupled to the right side, i.e., the rear side of the shell 211, and the second shell cover 213 may be coupled to the left side, i.e., the front side.

A suction port 214 is formed in the first shell cover 212 and a suction pipe 215 is inserted in and coupled to the suction port 212*a*. The shell 211 is provided with a discharge port 211*a* through which the refrigerant is discharged to the outside from the discharge space 204, and a discharge pipe (not shown) is inserted into the discharge port 211*a*.

A compressor main body C is provided inside the shell 211. The compressor main body C includes a driving unit 220 formed of a linear motor and a compression unit 230 compressing a refrigerant when a piston 232 reciprocates in a cylinder 231 together with a mover 222 of the driving unit 220.

The compressor main body C according to the present embodiment is similar to the compressor main body of the above-described embodiments. For example, in the compressor main body C according to the present embodiment, a stator 221 constituting a driving unit 220 formed of a linear motor is axially supported by a frame 240, and a cylinder 231 is inserted and coupled to a cylinder space 222*a* provided inside the stator 221. A piston 231 is inserted into the cylinder 231 and reciprocates to suck the refrigerant into the compression space 203 of the cylinder 231, compress the refrigerant, and discharge the refrigerant.

A cylinder space 222*a* may be formed in the inner circumferential surface of the stator 221 and the cylinder 231 may be inserted into the cylinder space 222*a*. A cylinder support member 247 supported in an axial direction is provided between the inner circumferential surface of the stator 221 and the outer circumferential surface of the cylinder 231. One end of the cylinder support member 247 is axially supported on the stator 221 while the other end thereof supports the end portion of the cylinder 231 in the axial direction. A basic configuration of the cylinder support member 247 is the same as those of the above-described embodiments, and thus, a description thereof will be omitted.

Accordingly, since the frame 240 has a disk shape, the structure of the frame 240 may be simplified. In addition, since the frame is excluded between the stator 221 and the cylinder 231, it is possible to reduce the outer diameter of the motor compared to a compression space having the same capacity, or to enlarge the outer diameter of the compression space compared to the motor having the same capacity. This effect may be the same as that of the above-described embodiment.

Furthermore, a mechanical resonance spring may be applied to the linear compressor according to the present embodiment. However, also in this embodiment, it is possible to exclude the mechanical resonance spring as in the above-described embodiment, and the mover and the piston may be resonated using a magnetic spring. Since this has been described in the above embodiment, a detailed description thereof will be omitted.

Meanwhile, first guides 261 and 271 are provided on both sides of the compressor main body C, respectively. Second guides 262 and 272 respectively slidably coupled with the first guides 261 and 271 may be provided in the first shell cover 212 and the second shell cover 213.

The first guides 261 and 271 may include a rear side first guide 261 provided on the rear side of the compressor main body C and protruding toward the first shell cover 212 and a front side first guide 271 provided on the front side of the compressor main body C and protruding toward the second shell cover 213.

The second guides 262 and 272 may include a rear side second guide 262 provided in the first shell cover 212 and protruding toward the rear side first guide 261 and a front side second guide 272 provided in the second shell cover 213 and protruding toward the front side first guide 271.

The rear side first guide 261 and the rear side second guide 262 have a hollow cylindrical shape. The rear side first guide 261 includes a first insertion hole 261*a* through which the rear side second guide 262 is slidably inserted, and the rear side second guide 262 has a refrigerant guide hole 262*a* communicating with the suction pipe 215.

Also, a refrigerant communication hole 261*b* is formed in the rear side first guide 261 so that the first insertion hole 216*a* communicates with the suction space 201 of the casing 210 or a suction passage 202 of the piston 232. Accordingly, the refrigerant sucked through the suction pipe 215 may be guided to the suction space 201 of the casing 210 or the suction passage 202 of the piston 232 through the refrigerant guide hole 262*a* of the rear side second guide 262, the first insertion hole 261*a*, and the refrigerant communication hole 261*b*. The refrigerant opens the suction valve 233 to move to the compression space 203, and the compressed refrigerant opens the discharge valve 234 by the piston 232 and moves to the discharge space 204.

The front side first guide 271 has a shape of a solid circular bar and is coupled to the discharge cover 248. The front side second guide 272 has a hollow cylindrical shape such that the front side first guide 271 is slidably inserted therein. The front side first guide 271 and the front side second guide 272 are each provided on the inner surface of the second shell cover 213. The front side first guide 271 protrudes toward the front side second guide 272 and the front side second guide 272 protrudes toward the front side first guide 271.

A second insertion hole 272*a* is formed inside the front side second guide 272 and a second insertion hole 272*a* has structure in which one side thereof is blocked, unlike the first insertion hole 261*a*. Accordingly, although not illustrated, a gas discharge hole may be formed on a circumferential surface to prevent generation of a resistance force due to gas pressure when the front side first guide 271 reciprocates together with the compressor main body C.

Since the first guides 261 and 271 provided in the compressor main body C are slidably inserted into the second guides 262 and 272 provided in the casing 210, the compressor main body C may be supported radially with respect to the casing 210, even without a separate support spring.

That is, when the compressor main body C vibrates, the rear side second guide 262 slides and reciprocates with respect to the rear side first guide 261, so that the rear side first guide 261 may be supported in a radial direction by the rear side second guide 252, and as the front side first guide 271 slides and reciprocates with respect to the front side second guide 272, so that the front side first guide 271 may be supported by the front side second guide 272 in the radial direction. Also, since a guide, which is inserted into the first insertion hole 261*a* and the second insertion hole 272*a* and slides, among the first guides 261 and 272 and the second guides 262 and 272, is limited in an axial movement by the counterpart guide, a separate fixing structure (stopper) for limiting a movement of the compression main body C in a horizontal direction may be excluded. Accordingly, the number of components may be further reduced.

In addition, since the first guides 261 and 272 and the second guides 262 and 272 are brought into contact with each other to make a relative movement, any one of the first guides 261 and 272 and the second guides 262 and 272 may be formed of a material having good lubricating characteristics to reduce friction loss. For example, one of the first guide 261 and 271 and the second guides 262 and 272 may be formed of a metal material to ensure strength and the other may be formed of a plastic material to ensure lubricating characteristics. A coating surface may be formed with a lubricating material on an inner circumferential surface of the guide formed of a metal material.

Meanwhile, in the linear compressor according to the present disclosure, another embodiment of a support device for supporting the compressor main body will be described. That is, in the above-described embodiment, the first guide and the second guide reciprocate only by a thrust and a restoring force generated by the compressor main body. However, as in the present embodiment, an elastic member may be further provided between the first guide and the second guide.

Figure 24:
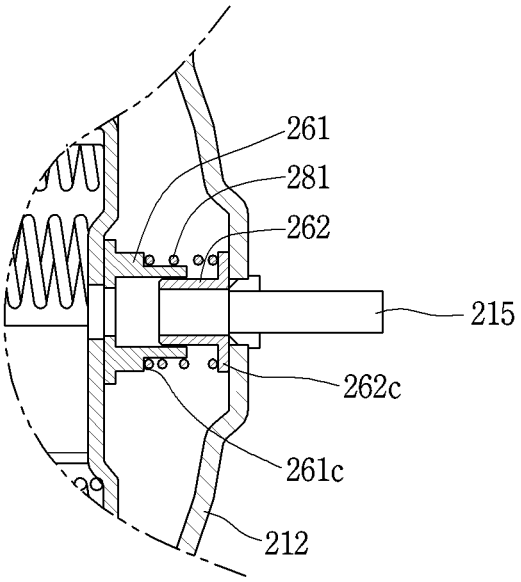
FIGS. 24 and 25 are cross-sectional views illustrating other embodiments of a support device of a compressor main body in the linear compressor according to FIG. 22.

FIG. 24 is a cross-sectional view illustrating another embodiment of a support device for a compressor main body in a linear compressor according to FIG. 22, in which the rear side first and second guides are enlarged. As illustrated in the figure, an elastic member 281 (not shown) may be provided between the rear side first guide 261 and the rear side second guide 262 and between the front side first guide 271 and the front side second guide 272. Of course, the elastic member may be provided only on one side among the front side and the rear side. In the drawing, rear side first and second guides are illustrated.

The elastic member 281 may be configured as a compression coil spring. However, in some cases, a bush-shaped member formed of an elastic material such as a tension coil spring, a wave spring, or rubber may be inserted.

Also, the elastic member 281 is provided so as to fit to the outer circumferential surface of the first guide 261 or the second guide 262, and flanges 261*c* and 262*c* may extend from the cross-section of the first guide or the second guide to support the end of the elastic member 281.

As described above, in case where the elastic member is provided between the first guide and the second guide, it is possible to absorb an impact force generated when the first guide moves along the second guide.

Meanwhile, another embodiment of a support device for supporting the compressor main body in the linear compressor according to the present disclosure is as follows. That is, in the above-described embodiment, the first shell cover includes the separate rear side second guide and the suction pipe communicates with the rear side second guide, but the suction pipe may be utilized as a rear side second guide as in this embodiment.

Figure 25:
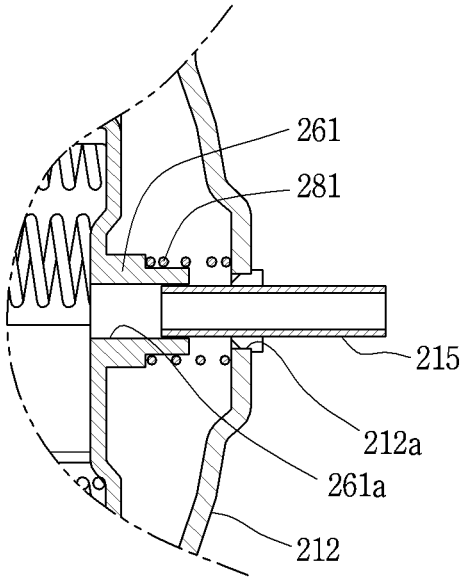

FIG. 25 is a cross-sectional view illustrating another embodiment of a support device for a compressor main body in the linear compressor according to FIG. 22, in which the rear side first and second guides are enlarged.

As illustrated in the figure, the support device according to the present embodiment has the suction port 212*a* formed in the first shell cover 212 and the suction pipe 215 inserted into the suction port 212*a*.

The suction pipe 215 is inserted deeply into the compressor main body C by a predetermined depth. The suction pipe 215 is slidably inserted into and coupled to the first insertion hole 261*a* of the rear side first guide 261.

The suction pipe 215 has a length sufficient for the suction pipe 215 not to collide in the first insertion hole 261*a* or not to be separated from the first insertion hole 261*a* when the compressor main body C reciprocates in a state of being inserted in the first insertion hole 261*a*.

As described above, when the suction pipe 215 is deeply inserted into the casing 210 and slidably coupled with the rear side first guide 261, the compressor main body C may be supported in the radial direction with respect to the casing 210, even without a separate rear side second guide inside the casing 210. Thus, the number of components may be further reduced to reduce manufacturing cost.

Meanwhile, another embodiment of the linear compressor according to the present disclosure is as follows. That is, in the above-described embodiments, the compressor main body is radially supported by the support spring or the plurality of guides in the casing in which the internal space is sealed, but the casing may be excluded and the compressor main body may be exposed to the outside (room temperature) as in the present embodiment.

Figure 26:
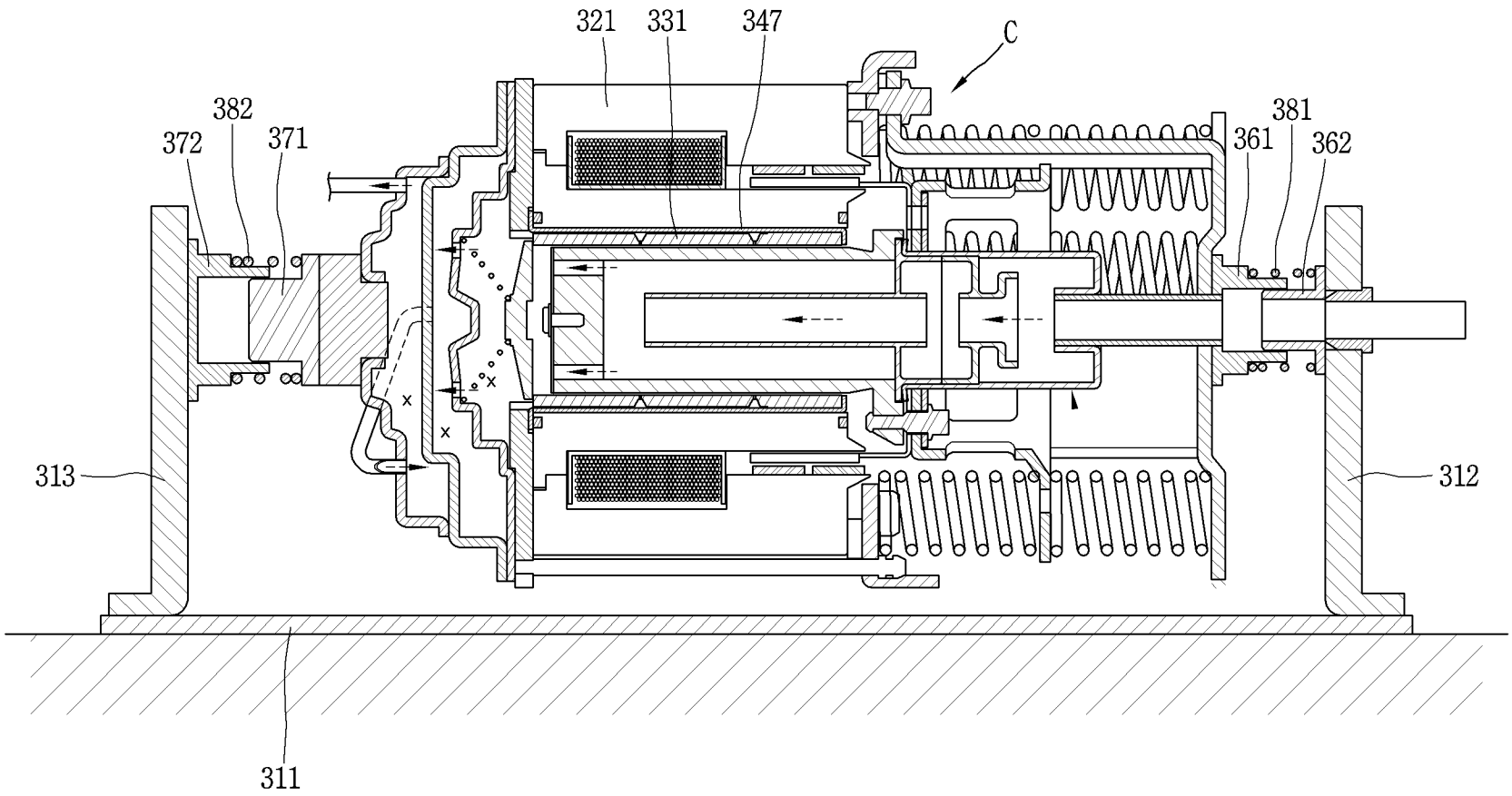
FIG. 26 is a cross-sectional view illustrating another embodiment of a linear compressor according to the present disclosure.

FIG. 26 is a cross-sectional view illustrating another embodiment of a linear compressor according to the present disclosure. As illustrated, in the linear compressor according to the present embodiment, the compressor main body C may be supported in the radial direction using the first and second guides 361 and 371 and the guides 362 and 372 described above in the support brackets 311, 312, and 313.

The support brackets 311, 312 and 313 may include a first bracket 311 forming a bottom portion and second and third brackets 312 and 313 forming both side column portions. The first bracket 311 may be installed on the bottom surface at a lower portion of the compressor, and the second and third brackets 312 and 313 may be installed upwards at both ends of the first bracket 311.

The second bracket 312 and the third bracket 313 correspond to the first shell cover and the second shell cover described above. The second bracket 312 and the third bracket 313 may have a rear side second guide 362 and a front side second guide 372, respectively. The rear side second guide 362 and the front side second guide 372 may be slidably inserted into the rear side first guide 361 and the front side first guide 371 provided at both ends of the compressor main body C, respectively.

Further, an elastic member 381 or 382 such as a coil spring may be further provided between the rear side first guide 361 and the rear side second guide 362 or between the front side first guide 371 and the front side second guide 372. An operational effect of the elastic member is the same as that of the previous embodiment described above.

Meanwhile, in the compressor main body C according to the present embodiment, a cylinder 331 is inserted into and coupled to an inner circumferential surface of a stator 321 and a cylinder support member 347 is provided between the stator 321 and the cylinder 331 to support the cylinder 331 with respect to the stator 321 in an axial direction, which is the same as those of the previous embodiments described above. A basic configuration of the compressor main body and an operational effect thereof are the same as those of the compressor main body of the previous embodiment described above. Thus, a detailed description thereof will be omitted.

As described above, when the closed casing is excluded and the compressor main body is supported using the plurality of guides, the size of the compressor may be reduced. In addition, heat generated by the compressor main body may be rapidly dissipated, increasing efficiency of the compressor.

The foregoing embodiments and advantages are merely exemplary and are not to be considered as limiting the present disclosure. The present teachings may be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A linear compressor comprising:

a casing;

a stator spaced apart from the casing and configured to generate driving force, the stator defining a cylinder space at an inside of the stator;

a mover configured to reciprocate relative to the stator based on driving force generated by the stator;

a cylinder that is located in the cylinder space and that defines a compression space configured to compress refrigerant;

a piston located inside of the cylinder and configured to reciprocate relative to the cylinder in an axial direction of the cylinder;

a frame that is spaced apart from the casing and that is in contact with a first side of the stator to support the stator in the axial direction;

a stator cover that is configured to support a second side of the stator in the axial direction and that is fastened to the frame by an assembly member passing through the stator; and a cylinder support member that is spaced apart from the frame in the axial direction, that is located between an inner circumferential surface of the stator and an outer circumferential surface of the cylinder, and that has a first end coupled to the stator and a second end coupled to the cylinder, the cylinder support member being configured to support the cylinder with respect to the stator in the axial direction, wherein the frame and the cylinder support member are individually provided, and wherein the cylinder support member comprises:

a cylindrical portion, a first bent portion that is located at a first end of the cylindrical portion, that is bent radially outward to the stator, and that is configured to be supported by the stator in the axial direction, and a second bent portion that is located at a second end of the cylindrical portion opposite to the first end, that is bent radially inward to the cylinder, and that is configured to support an area of the cylinder in the axial direction.

2. The linear compressor of claim 1, wherein the stator defines:

a receiving recess that is defined at a portion of the inner circumferential surface of the stator and that faces the cylindrical portion; and a fixing recess that is recessed outward relative to the receiving recess and that faces the first bent portion, and wherein the cylinder support member is configured to, based on insertion of the first bent portion to the fixing recess, support the stator in the axial direction.

3. The linear compressor of claim 2, wherein the stator comprises a sealing portion that is located at the inner circumferential surface of the stator and that allows refrigerant to be accommodated between the inner circumferential surface of the stator and the outer circumferential surface of the cylinder, and wherein a thickness of the sealing portion is less than a thickness of the cylinder support member.

4. The linear compressor of claim 2, wherein a length of the cylinder support member in the axial direction is less than a length of the cylinder in the axial direction, wherein the stator defines an annular seating recess that is recessed from the inner circumferential surface of the stator and that is configured to receive the cylindrical portion of the cylinder support member, and wherein a depth of the annular seating recess in a radial direction of the cylinder is greater than or equal to a thickness of the cylindrical portion in the radial direction.

5. The linear compressor of claim 1, wherein at least one of the stator or the frame defines a recess configured to receive the first bent portion of the cylinder support member, the recess being located at a side surface of the stator in the axial direction or at a side surface of the frame facing the side surface of the stator in the axial direction, and wherein the cylinder support member is configured to, based on insertion of the first bent portion to the recess, support the stator in the axial direction.

6. The linear compressor of claim 5, wherein a length of the cylinder support member in the axial direction is greater than a length of the cylinder in the axial direction.

7. The linear compressor of claim 1, further comprising a discharge valve that is located at an end surface of the cylinder, that is located inside of the cylinder space, and that is configured to open and close at least a portion of the compression space.

8. The linear compressor of claim 1, further comprising a discharge valve that is located at an end surface of the cylinder, that is located outside of the cylinder space, and that is configured to open and close at least a portion of the compression space.

9. The linear compressor of claim 1, wherein a thickness of the cylinder support member in a radial direction of the cylinder is less than a thickness of the frame in the axial direction.

10. The linear compressor of claim 9, wherein the cylinder support member is made of a material having a rigidity that is greater than a rigidity of the frame.

11. The linear compressor of claim 1, wherein the cylinder space comprises at least one discharge space configured to accommodate refrigerant discharged from the compression space.

12. The linear compressor of claim 11, further comprising a discharge cover configured to couple to the frame and to cover the cylinder space.

13. The linear compressor of claim 12, wherein the frame includes a cover part integrally formed with the frame and configured to cover the cylinder space.

14. The linear compressor of claim 1, wherein the stator defines a fixing recess that is recessed from the inner circumferential surface of the stator, wherein the cylinder support member has an annular disk shape, and wherein the cylinder support member includes:

an outer circumferential portion configured to insert into and couple to the fixing recess of the inner circumferential surface of the stator, and an inner circumferential portion configured to contact an end of the cylinder and to support the cylinder in the axial direction.

15. The linear compressor of claim 1, wherein the cylinder defines a bearing hole configured to guide refrigerant discharged from the compression space to a space between the cylinder and the piston.

* * * * *